US006262495B1

(12) United States Patent
Yablonovitch et al.

(10) Patent No.: US 6,262,495 B1
(45) Date of Patent: Jul. 17, 2001

(54) CIRCUIT AND METHOD FOR ELIMINATING SURFACE CURRENTS ON METALS

(75) Inventors: Eli Yablonovitch, Malibu; Dan Sievenpiper, Los Angeles, both of CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/255,832

(22) Filed: Feb. 23, 1999

Related U.S. Application Data

(60) Provisional application No. 60/079,953, filed on Mar. 30, 1998.

(51) Int. Cl.[7] ..... H01Q 1/38
(52) U.S. Cl. ..... 307/101; 327/593; 333/12
(58) Field of Search ..... 307/101; 333/12, 333/235; 343/700 R; 331/117 R; 257/259; 327/593; 365/54

(56) References Cited

U.S. PATENT DOCUMENTS 5,576,718 * 11/1996 Buralli et al. ..... 343/700 R
5,942,950 * 8/1999 Merenda ..... 331/117
6,008,762 * 12/1999 Nghiem ..... 343/700 R
6,023,209 * 2/2000 Faulkner et al. ..... 331/12

* cited by examiner

*Primary Examiner*—Albert W. Paladini
(74) *Attorney, Agent, or Firm*—Myers, Dawes, & Andras LLP; Daniel L. Dawes, Esq.

(57) ABSTRACT

A two dimensional periodic pattern of capacitive and inductive elements defined in the surface of a metal sheet are provided by a plurality of conductive patches each connected to a conductive back plane sheet between which an insulating dielectric is disposed. The elements acts to suppress surface currents in the surface defined by them. In particular, the array forms a ground plane mesh for use in combination with an antenna. The performance of a ground plane mesh is characterized by a frequency band within which no substantial surface currents are able to propagate along the ground plane mesh. Use of such a ground plane in aircraft or other metallic vehicles thereby prevents radiation from the antenna from propagating along the metallic skin of the aircraft or vehicle. This eliminates surface currents between the antenna and the ground plane thereby reducing power loss and unwanted coupling between neighboring antennae. The surface also reflects electromagnetic waves without the phase shift that occurs on a normal metal surface. This allows antennas to be constructed that were previously impractical.

24 Claims, 20 Drawing Sheets

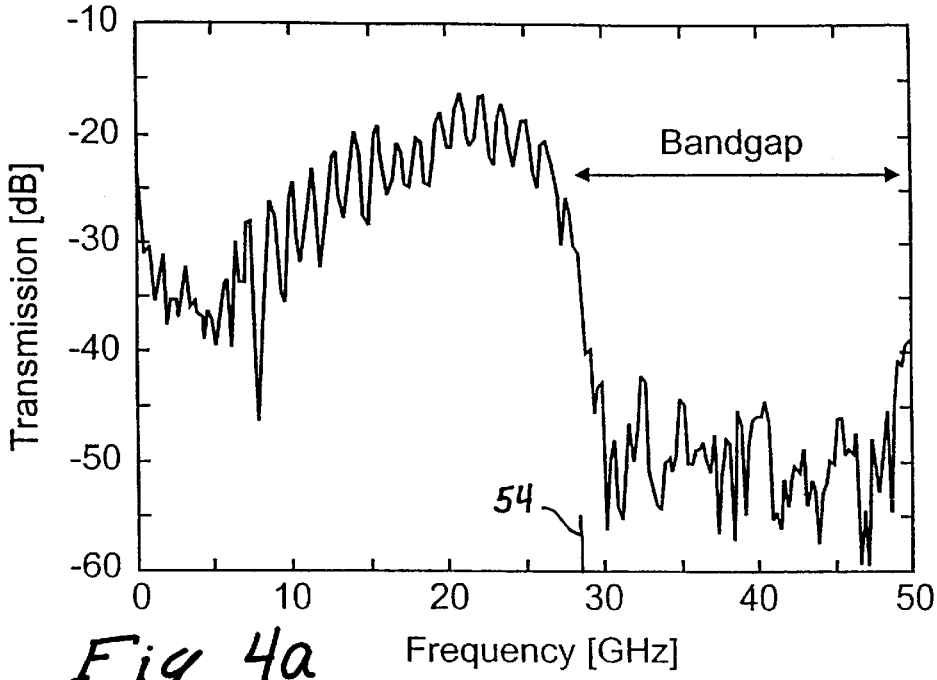
Fig. 4a
Fig. 4b PRIOR ART
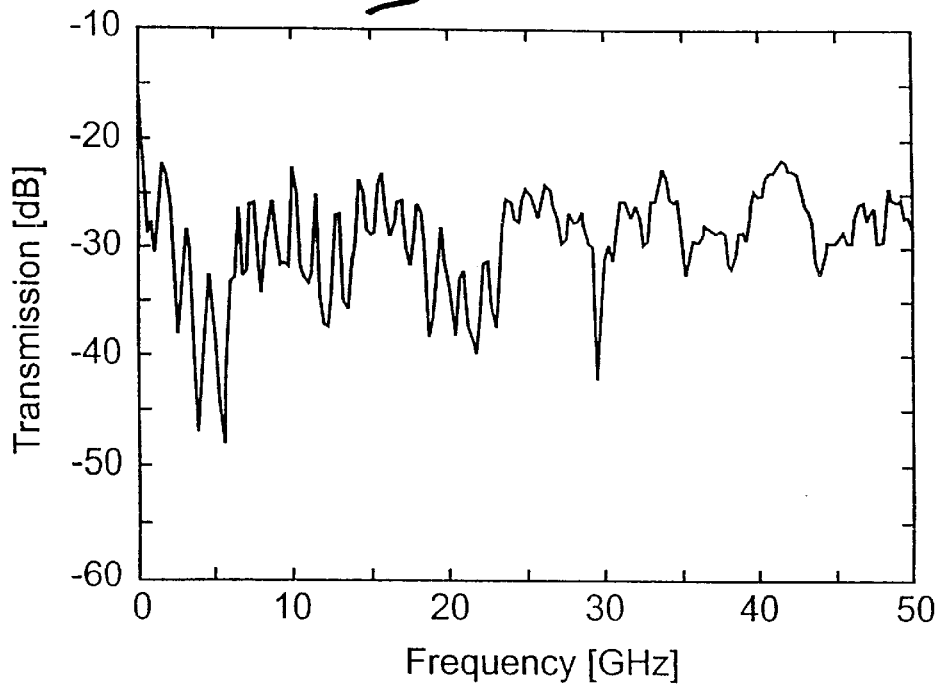

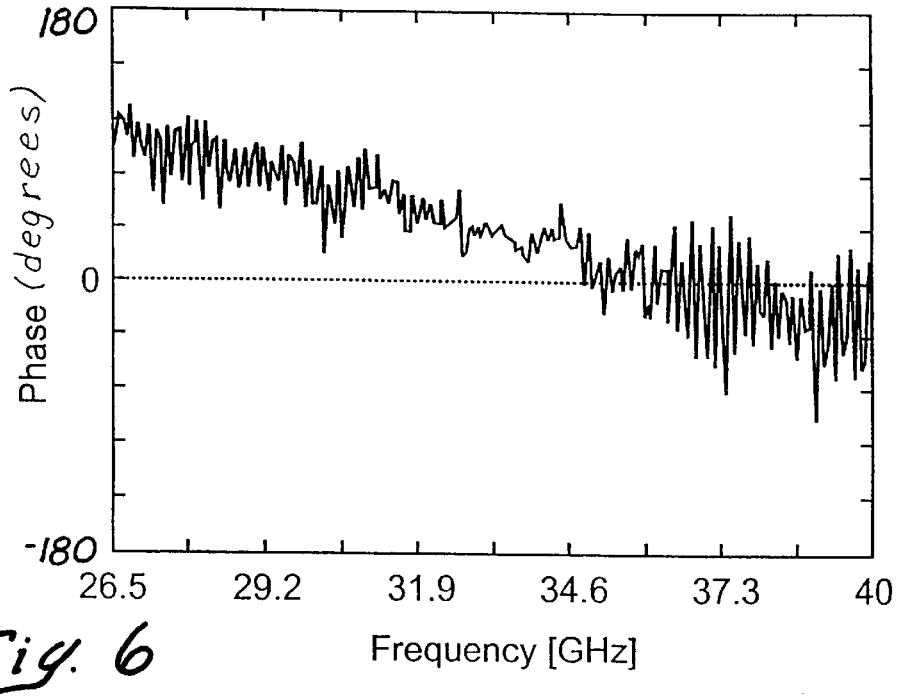
Fig. 6
Fig. 12
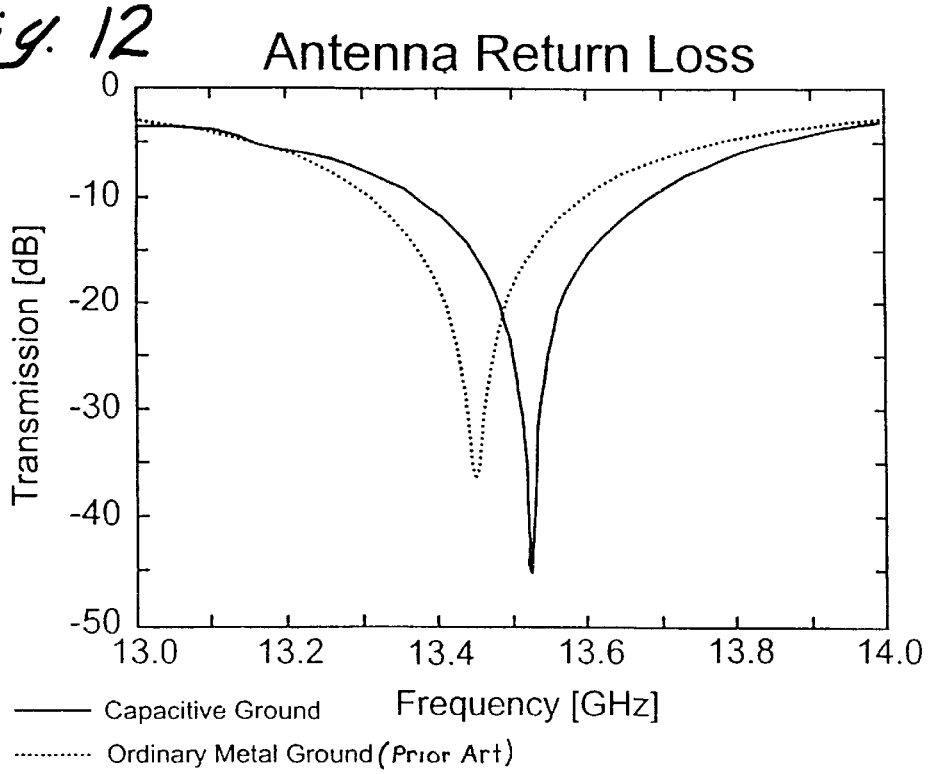

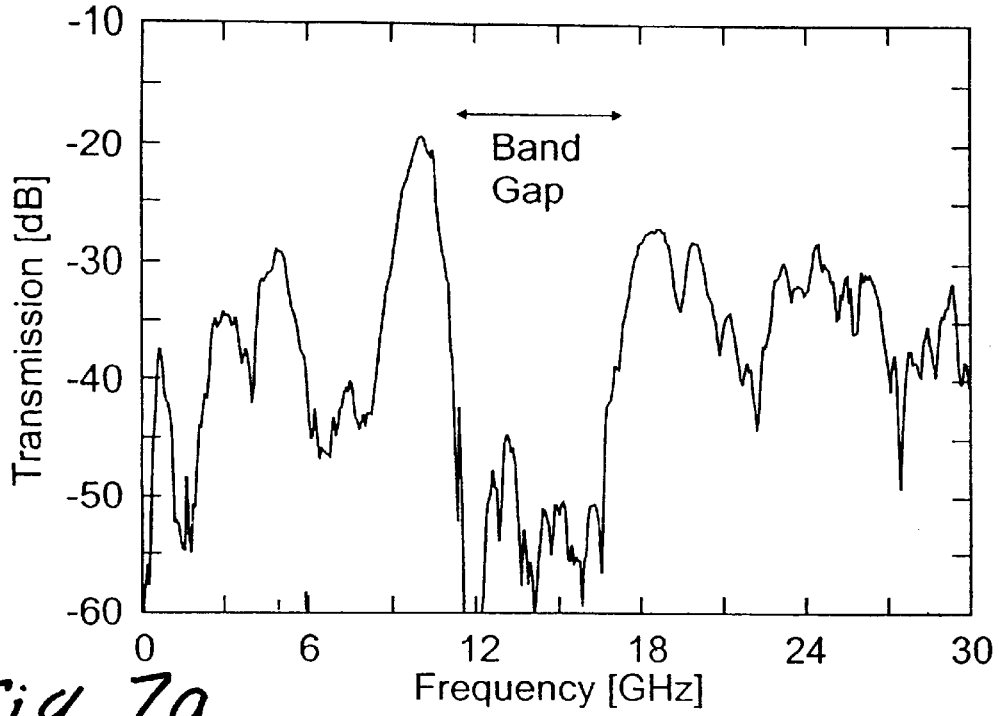
Fig. 7a
Fig. 7b
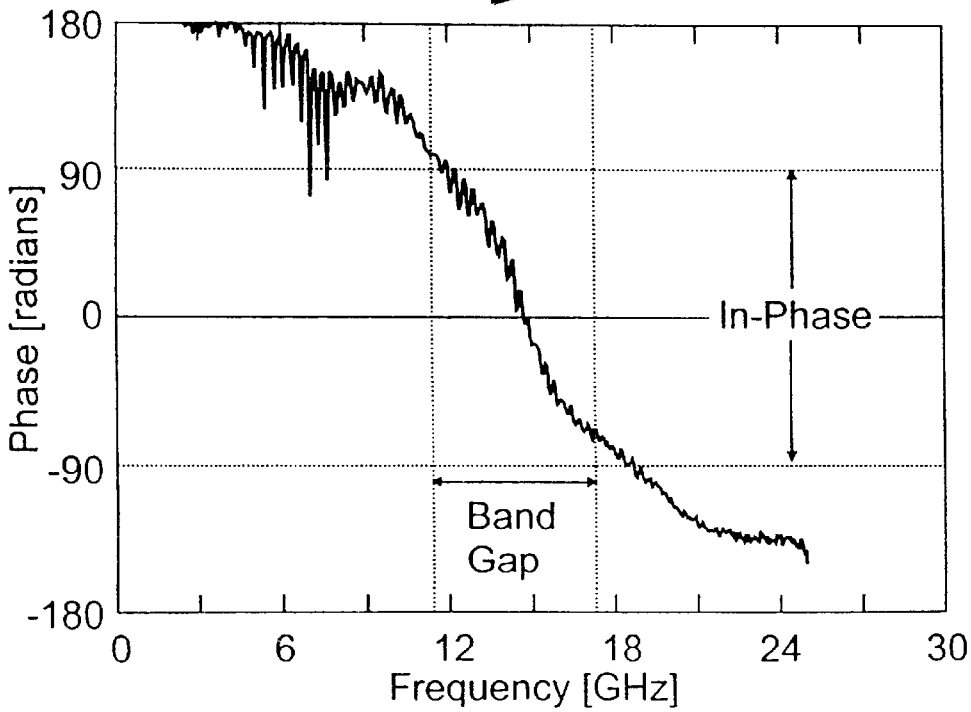

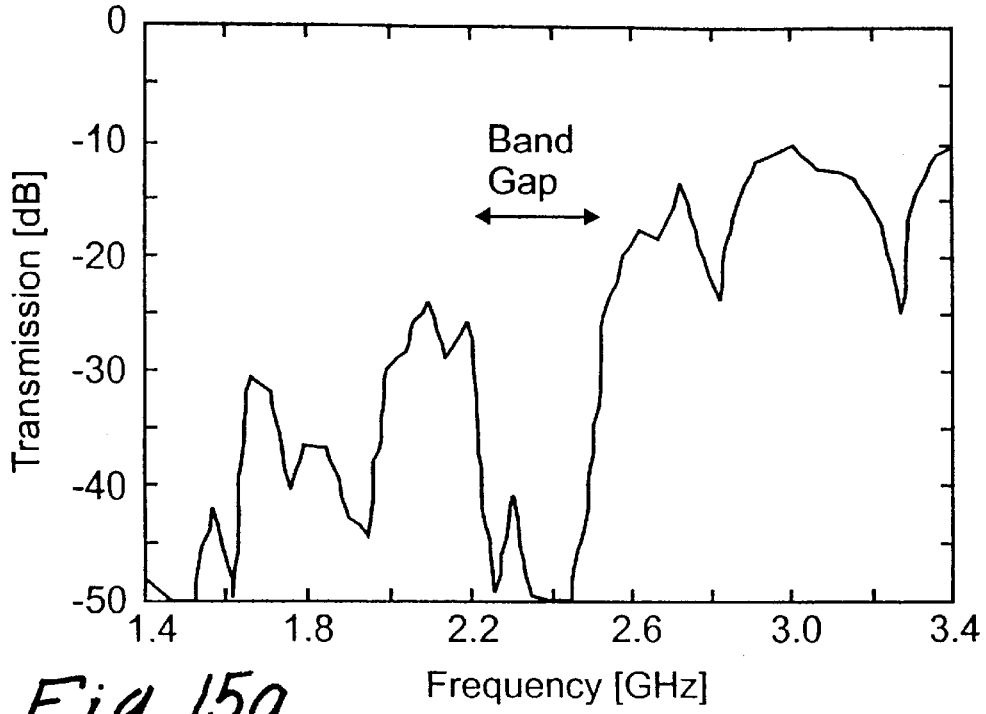
Fig. 15a
Fig. 15b
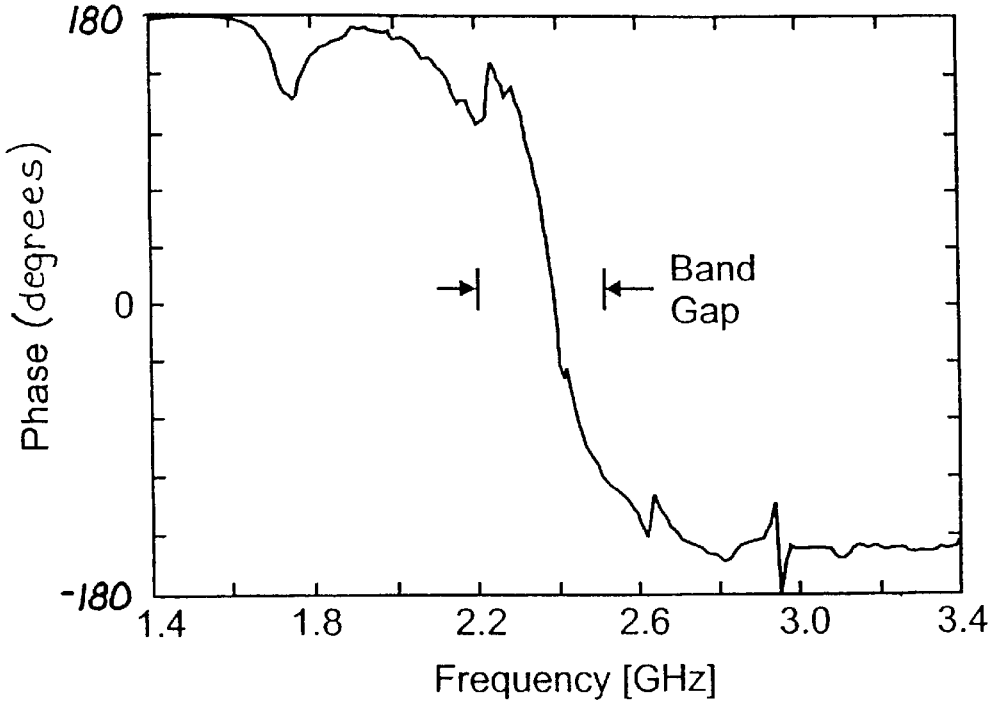

CIRCUIT AND METHOD FOR ELIMINATING SURFACE CURRENTS ON METALS

RELATED APPLICATION

The present application is related to provisional patent application Serial No. 60/079,953 filed on Mar. 30, 1998.

The invention was made with Government support under Grant no. DAAH04-96-1-0389 awarded by the U.S. Army Research Office. The Government has certain rights in this invention.

BACKGROUND OF THE INVENTION

1. Field of the Invention

The field of the endeavor of the invention relates to ground planes for antennas and in particular to a method of reducing surface currents induced by the antenna on the ground plane.

2. Description of the Prior Art

A ground plane is a common feature of most radio frequency and microwave antennas. It is comprised of a conductive surface lying below the antenna and often performs a useful function by directing most of the radiation into one hemisphere in which the antenna is located. Frequently, the ground plane is present by necessity rather than by intent as in the case of a metal-skinned aircraft. For many types of antennas, the ground plane degrades antenna performance and/or dictates the antenna design itself. The most obvious constraint is that the tangent electric field on the conductive surface must be zero, so that electromagnetic waves experience a 180° phase shift on reflection. This often imposes a minimum height of about a quarter wavelength on the antenna. Furthermore, RF surface currents can propagate freely along the metal surface of the ground plane. These surface currents result in lost power due to radiation from edges or other discontinuities, and interference between nearby antennas on the aircraft. In phased arrays, surface currents are particularly problematic, contributing to coupling between antenna elements and causing blind angles.

What is needed is some type of method or design which provides a metallic surface which forbids RF current propagation and reflects electromagnetic waves with zero phase shift.

What is further needed is some type of method or apparatus whereby surface currents on ground planes associated with antennas can be suppressed to provide more efficient antennas, reduce coupling between elements in a phased array, and reduce interference between nearby antennas on aircraft.

Further, what is needed is a reflector which lacks edge currents that radiate power into the back hemisphere of the antenna.

What is needed is also ground plane in which a non-shifted phase of the reflected waves enable smaller antennas to be realized, since the radiating elements can be located very near the surface of the ground plane without being shorted out by it.

BRIEF SUMMARY OF THE INVENTION

The invention is an apparatus for reducing electromagnetically induced surface currents in a ground plane comprising a plurality of elements. Each element is a resonant circuit. Each of the elements is interconnected with each other to form an array. Each resonant circuit has an exposed surface. The corresponding plurality of exposed surfaces of the plurality of elements define the ground plane.

Each of the elements electrically functions as an LC resonant circuit. Each of the elements has a subplurality of adjacent elements and is capacitively coupled to each of the adjacent elements. Each of the plurality of elements is inductively coupled together in common.

In the illustrated embodiment, the array of elements comprises a corresponding plurality of separate conductive patches forming a surface. A common conductive back plane is separated by a predetermined distance from the surface of the patches. The plurality of patches form a common surface. Each of the plurality of patches is coupled by a conductive line to the separated back plane. The apparatus further comprises a dielectric material disposed between the back plane and the surface defined by the plurality of elements.

In the illustrated embodiment, the dielectric material is a dielectric sheet. The plurality of patches are conductive patches formed on a first surface of the dielectric sheet and the back plane is a continuous conductive surface disposed on an opposing surface of the dielectric sheet. The lines connecting the patches to the back plane are metalizations formed in vias defined through the dielectric sheet. The patches are hexagonal metalizations defined on the first surface of the dielectric sheet.

The plurality of resonant elements are parameterized to substantially block surface current propagation in the apparatus within a predetermined frequency band gap. In particular, the plurality of elements are parameterized to reflect electromagnetic radiation from the apparatus with a zero phase shift at a frequency within a frequency band gap.

The apparatus further comprises an antenna disposed above or inside the surface of resonant elements. In particular the antenna is comprised of a radiative element disposed parallel to the surface of the resonant elements, which act as a ground plane for the antenna.

In one embodiment the antenna is a wire antenna. In another embodiment the antenna is a patch antenna. The patch antenna may be substituted in position for one or more of the resonant elements and is disposed in the surface of the resonant elements.

In another embodiment the plurality of elements comprise at least a first and second set of elements. The first set of elements are disposed in a first defined plane which comprises the ground plane. The second set of elements is disposed in a second defined plane. The second defined plane is disposed above and spaced apart from the first ground plane. The arrays formed by the first and second sets of elements each form an overlapping mosaic, wherein each element of the second set overlaps and is spaced apart from at least one of the elements in the first set of elements. In other words the basic ground plane array has superimposed over it patches which are also connected to the back plane, but which form a second plane of metallic patches over the first plane of metallic patches.

In still another embodiment, the first and second set of elements each comprise in turn one or more corresponding subsets of elements. Each subset of the first set of elements are stacked over each other and each subset of the second set of elements are stacked over each other. The subset of the first set of elements are spaced apart from and adjacent to at least one subset of the second elements, so that two or more layers of alternating overlapping arrays of the first and second set of elements is provided. In other words, the double layered ground plane discussed above can be replicated an arbitrary number of times by vertically disposing alternating layers of the overlapping patches to form tiers of patches. The planes of patches can be added singly to comprise an odd number of planes or pairwise to provide an even number of planes.

A dielectric material can be disposed between each plane of patches and may either be the same type of dielectric material between each layer or the material may be selectively chosen to provide a graded plurality of layers of different types of dielectric materials.

The invention is also defined as a method of reducing surface currents in a conductive surface comprising the steps of providing the surface with a two dimensional array of a plurality of resonant elements. Each resonant element is coupled with each other and parameterized by geometry and materials to collectively exhibit a frequency band gap in which surface propagation is substantially reduced. Electromagnetic energy is radiated from a source disposed above the surface of resonant elements at a frequency within the frequency band gap so that electromagnetic radiation reflected from the surface has a zero phase shift at a frequency within the frequency band gap.

The surface which is provided is a plurality of conductive elements forming a periodic or nearly periodic array. Each element of the array has a subplurality of adjacent elements to which it is capacitively coupled. Each of the plurality of elements is inductively coupled in common with each other. In particular, the resonant array of elements which is provided is a plurality of conductive patches defining the periodic or nearly periodic array on a first surface and a continuous conductive second surface separated by a predetermined distance from the first surface. Each of the conductive patches of the first surface is inductively coupled to the continuous conductive second surface.

The step of radiating electromagnetic energy from a source comprises radiating electromagnetic energy from an antenna disposed parallel and adjacent to the surface of the array of elements, or radiating electromagnetic energy from an antenna disposed in the surface of the array of resonant elements.

The invention can be better visualized by now turning to the following drawings wherein like elements are referenced by like numerals.

BRIEF DESCRIPTION OF THE DRAWINGS

FIG. 2(*b*) is a top plan view of an actual two dimensional capacitive of ground plane structure of the ground plane mesh of the invention incorporating the distributed inductance and capacitance of FIG. 1(*a*).

FIG. 3*c* is a diagram illustrating a technique for measuring the reflection phase of the ground plane mesh. Plane waves are transmitted from a horn antenna, reflected by the ground plane, and received by a second horn antenna.

FIG. 4(*a*) is a graph of the transmission intensity versus frequency using the surface wave measurement technique shown in FIG. 3*a*. The band edge is shown at about 28 GHz. Above that frequency, surface currents do not propagate.

FIG. 4(*b*) is a graph of the transmission versus frequency for a conventional continuous metal sheet acting as a ground plane.

FIG. 5(*b*) is a polar radiation pattern of the same monopole shown in FIG. 5(*a*) operating at a frequency of 35.4 GHz. The radiation of the back hemisphere is reduced by 30 dB and the pattern shows no blind angles associated with multipath currents on the ground plane and exhibits only smooth main lobes.

FIG. 5(*c*) is a polar radiation pattern of a similar monopole under ordinary metal ground plane at 26.5 GHz.

FIG. 5(*d*) shows the polar radiation pattern of the monopole of FIG. 5(*c*) at 35.4 GHz.

FIG. 6 is a graph showing the phase of the reflected waves measured with respect to an ordinary metal surface of the ground plane mesh of the present invention as a function of frequency. It is depicted that the phase changes with the frequency and passes through a zero at about 35 GHz.

FIG. 7(*a*) is a graph of the surface wave transmission intensity as a function of frequency over the ground plane mesh of the invention. The band gap is clearly visible covering a range of 11 GHz to 17 GHz.

FIG. 7(*b*) is a graph of the phase shift of waves reflected from the ground plane mesh of the invention shown as a function of frequency. Within the band gap, waves are reflected in phase. Outside the band gap, waves are reflected out of phase as with ordinary continuous metal ground plane sheets.

FIG. 8(*b*) is a diagrammatic cross-sectional depiction of the same horizontal wire antenna using the ground plane mesh of the invention. Due to the favorable phase shift properties of the ground plane mesh, the antenna of FIG. 8(*b*) is not shorted out and radiates well.

FIG. 9(*b*) is the S11 return loss from the same antenna above the ground plane mesh of the invention as shown in FIG. 8(*b*). Below the lower band edge, the antenna performs similarly to the antenna on the ordinary ground plane sheet. Above the band edge, the return loss is around −10 dB (10%) indicating good antenna performance.

FIG. 10(*b*) is the polar radiation pattern of the horizontal antenna of FIG. 8(*b*). The radiation level is about 8 dB more than on the metal ground plane in FIG. 10(*a*) indicating much better antenna performance.

FIG. 11(*b*) is a diagrammatic side cross-sectional view of the same patch antenna of FIG. 11(*a*) but incorporated into the ground plane mesh of the invention.

FIG. 12 is the S11 measurement of both patch antennas of FIGS. 11(*a*) and 11(*b*) indicating that they have similar return loss and similar radiation band widths. The antenna of FIG. 11(*a*) is shown in dotted outline while the antenna of FIG. 11(*b*) is shown in solid outline.

FIG. 13(*b*) is the polar radiation pattern of the patch antenna of FIG. 11(*b*). This antenna has less backward radiation than the antenna of FIG. 11(*a*). The pattern is much more symmetrical and does not have ripples in the front hemisphere. These improvements are due to the suppression of surface currents by the ground plane mesh.

FIG. 14(*b*) is a top plan view of the structure shown in FIG. 14*a*. The top layer of metal patches are shown overlapping the second layer below.

FIG. 15(*a*) is a graph of the surface wave transmission intensity versus frequency on the structure depicted in FIG. 14(*a*) and FIG. 14(*b*). The band gap can be seen to cover the frequency range of 2.2 GHz to 2.5 GHz.

FIG. 15(*b*) is a graph of the reflection phase of the structure depicted in FIG. 14(*a*) and FIG. 14(*b*). The reflection phase crosses through zero at a frequency within the band gap.

The invention can be better understood by considering the illustrated embodiments are set forth in the following detailed description. The illustrated embodiments provided by example only and it is not intended to limit the invention which is defined by the following claims.

DETAILED DESCRIPTION OF THE PREFERRED EMBODIMENTS

A two dimensional periodic pattern of capacitive and inductive elements defined in the surface of a metal sheet are provided by a plurality of conductive patches each connected to a conductive back plane sheet between which an insulating dielectric is disposed. The elements acts to suppress surface currents in the surface defined by them. In particular, the array forms a ground plane mesh for use in combination with an antenna. The performance of a ground plane mesh is characterized by a frequency band within which no substantial surface currents are able to propagate along the ground plane mesh. Use of such a ground plane in aircraft or other metallic vehicles thereby prevents radiation from the antenna from propagating across the metallic skin of the aircraft or vehicle. This eliminates surface currents on the ground plane thereby reducing power loss and unwanted coupling between neighboring antennae.

Figure 1:
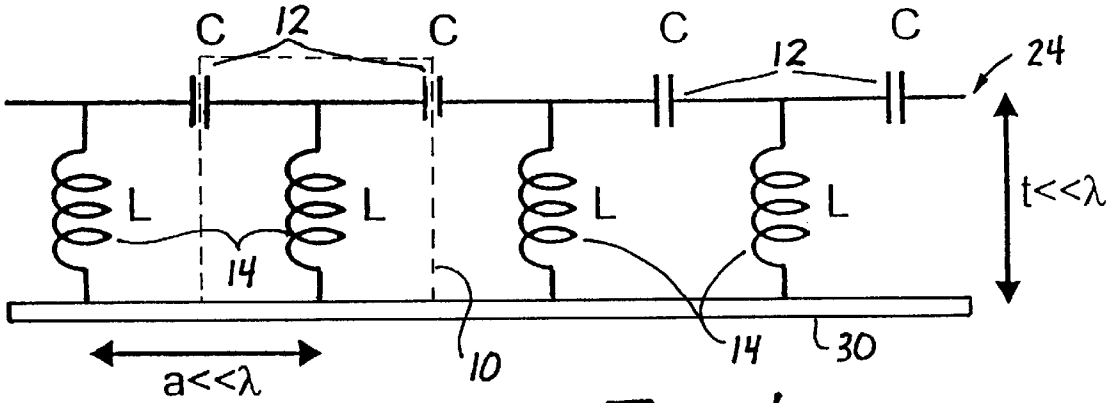
FIG. 1 is a circuit diagram equivalent of the ground plane mesh of the invention showing the ground plane metal sheet covered by a thin two dimensional layer of protruding elements, which are capacitively connected to each other and inductively connected to the back metal surface. The periodicity, a, of the metal elements on the opposing surface and the thickness, t, of the ground plane mesh are much smaller than the free space wavelength.

The invention is comprised of the continuous metal sheet 30 spaced apart from and covered with a thin, two-dimensional pattern of protruding metal elements 10 schematically denoted in FIG. 1 by dotted box 10. Each element 10 is capacitively coupled to its neighbors and inductively coupled to the metal sheet. Turn, for example, to the schematic diagram of FIG. 1 in which elements 10 are schematically shown as being capacitively coupled to each other by virtual capacitors 12 and inductively coupled to the sheet 30 by virtual inductors 14. Elements 10 are provided in the form of a thin mesh which thus acts as a two dimensional network of parallel resonant circuits, which dramatically alter the surface impedance of mesh 24 collectively comprised of the array of elements 10.

Figure 2A:
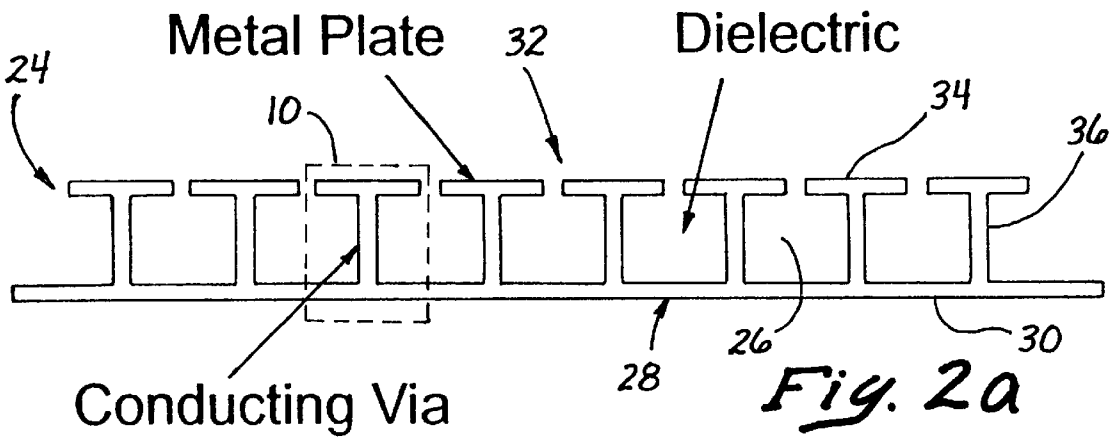
FIG. 2(*a*) is the side cross-sectional view of the ground plane mesh 24 of the invention.
Figure 2B:
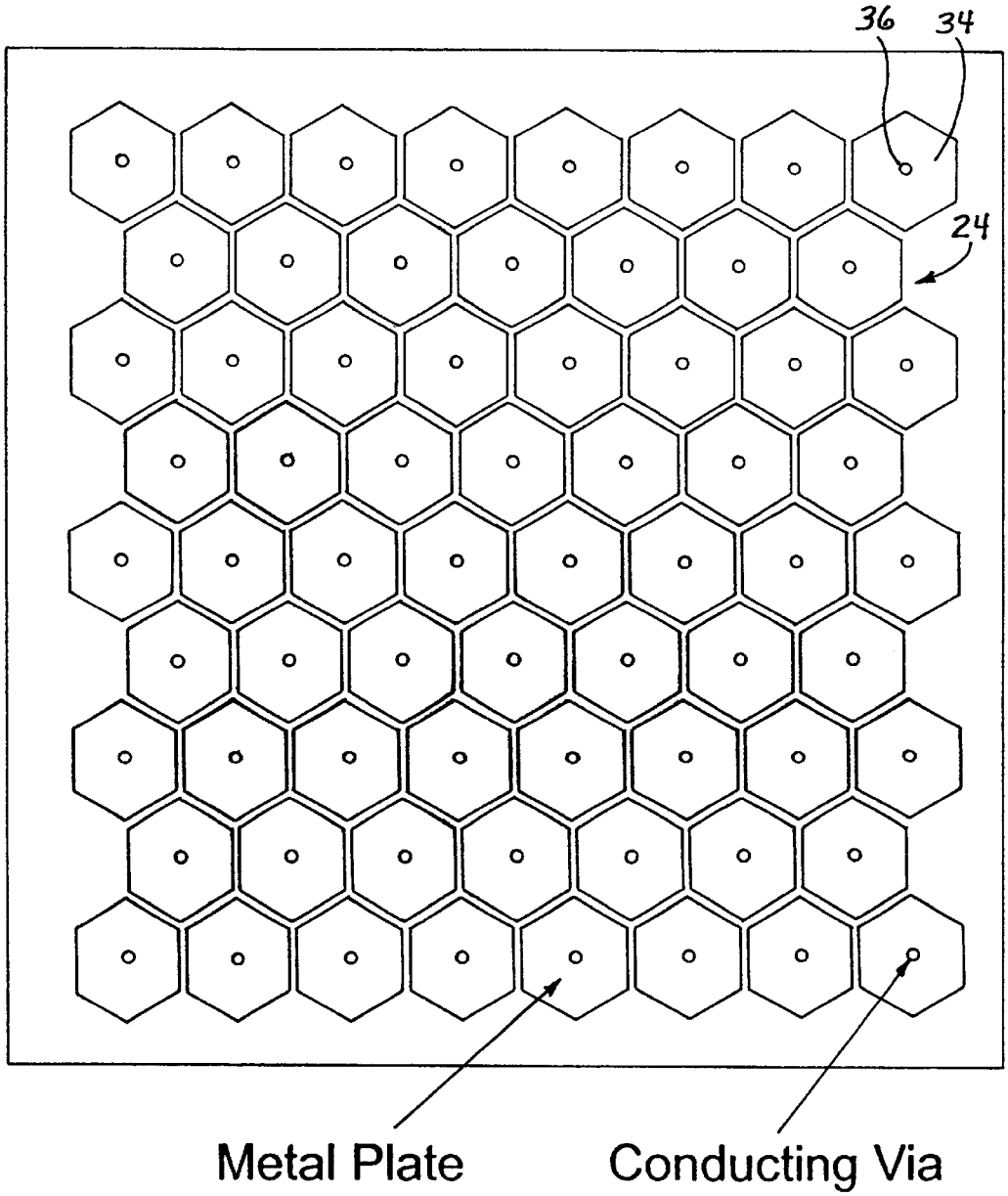

Turn now to the schematic diagram of FIG. 2(*a*). FIG. 2(*a*) is a side cross-sectional view of a printed circuit board in diagrammatic form which is a specific embodiment of mesh 24 and will be alternatively denoted as circuit board 24. Circuit board 24 is made of conventional insulating material 26. The back surface 28 of board 24 is provided with a continuous metal sheet 30, such as a sheet of copper cladding. Front surface 32 of board 24 is patterned with a two dimensional triangular lattice of hexagonal metal patches 34 each of which is coupled to rear plate 30 by means of a metal via connector 36. Clearly, the dimensions can be arbitrarily varied according to the application in a manner consistent with the teachings of the invention.

In effect, circuit board 24 is a two dimensional frequency filter preventing RF currents from running along metal surface 30. Even though patches 34 are arranged in a triangular lattice, it must be understood that the invention is not limited to this geometry nor need it be exactly periodic. The more important parameters are the inductance and capacitance of the individual elements on the surface. Hence, it must be explicitly understood that many other geometries and non-periodic patterns may be employed consistent with the teachings of the inventions with respect to the inductance and capacitance of each element.

FIG. 2(*b*) is a top plan view of ground plane mesh 24 of FIG. 2(*a*). Each element 34 is provided in the form of hexagon connected at its center with metal via 36. Hexagonal elements 34 form a triangular lattice across the surface of mesh 24.

Figure 3A:
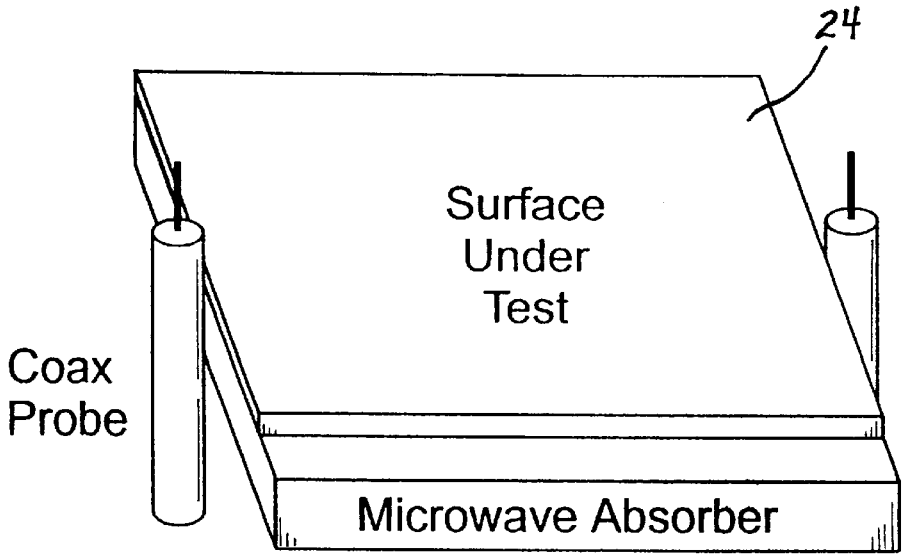
FIG. 3*a* is a diagram illustrating a technique for measuring surface waves modes on a ground plane mesh. The illustrated embodiment shows a vertical monopole antenna probe, which transmits surface waves across the ground plane, and a similar antenna for receiving the surface waves.
Figure 3B:
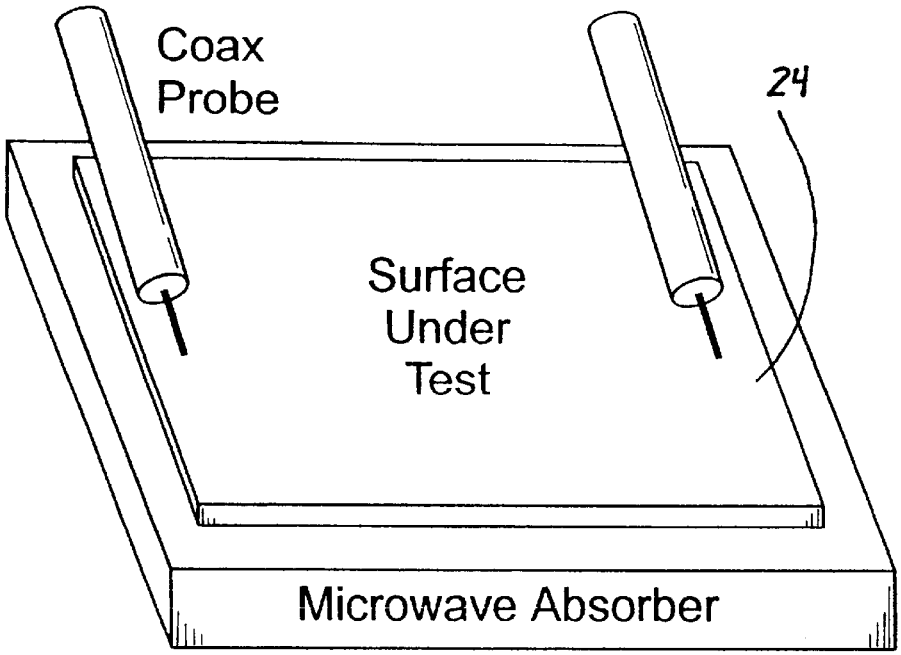
FIG. 3*b* is a diagram illustrating another technique for measuring surface waves across a ground plane mesh using monopole antenna probes which are horizontally oriented.
Figure 5A:
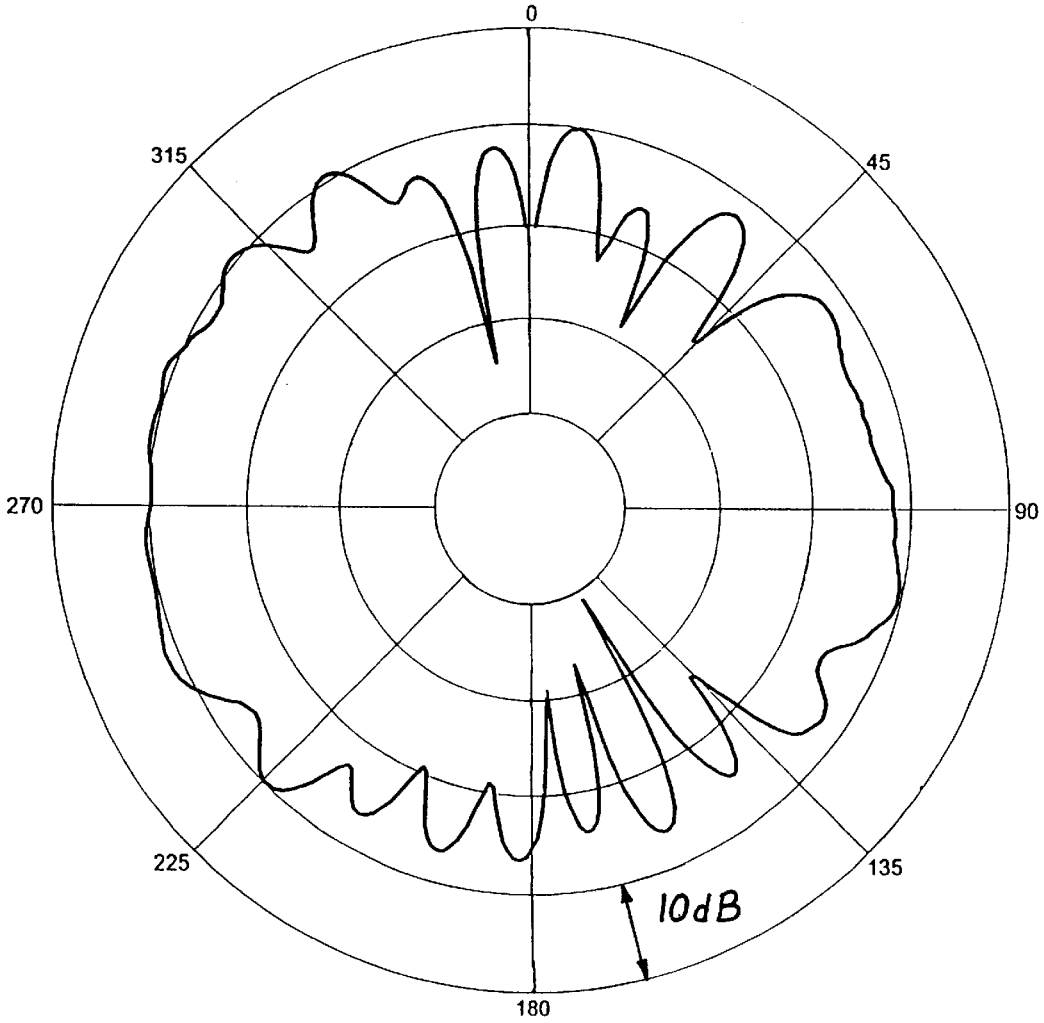
FIG. 5(*a*) is the polar radiation pattern of a monopole antenna mounted on the ground plane mesh of the invention operating below the band edge at a frequency of 26.5 GHz. The pattern shows many lobes and significant radiation to the back hemisphere due to surface currents.
Figure 5B:
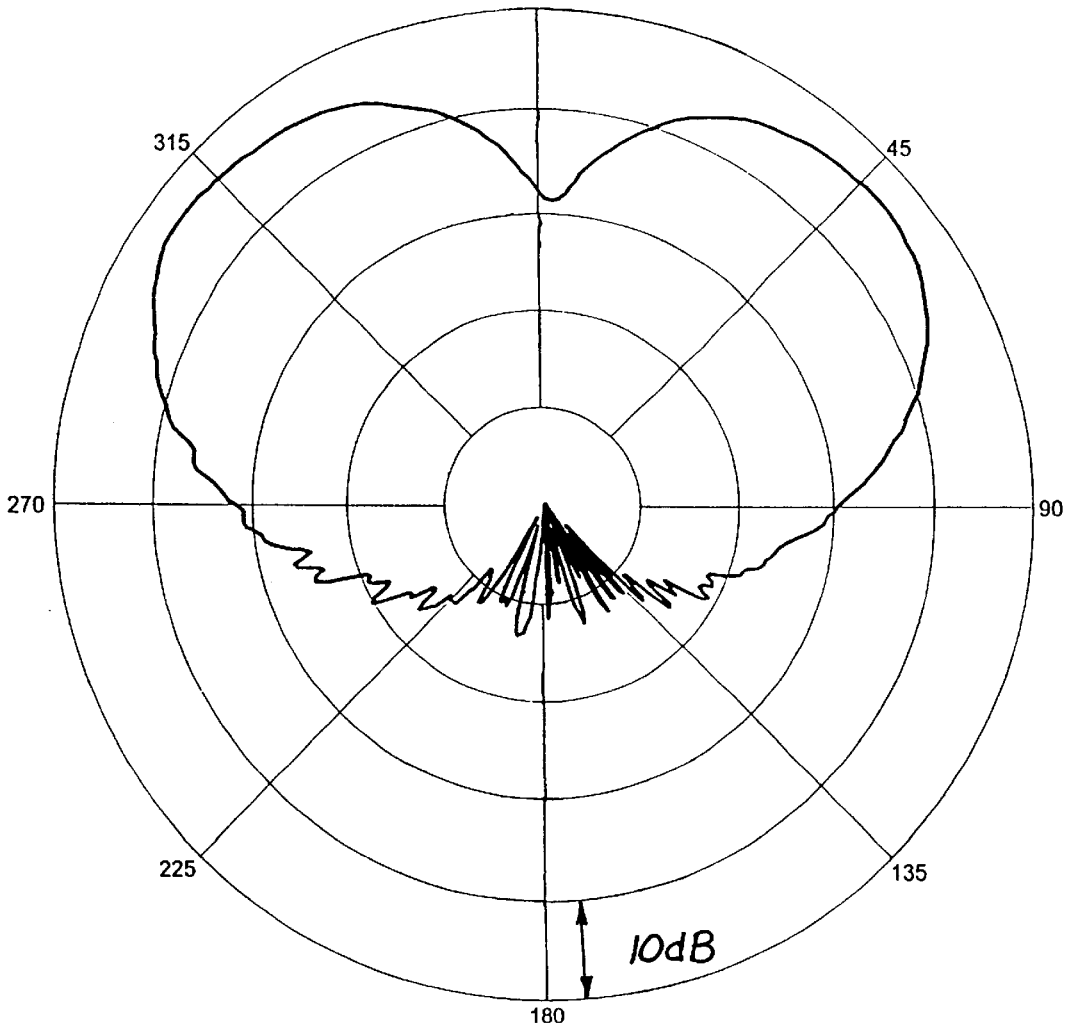
Figure 5C:
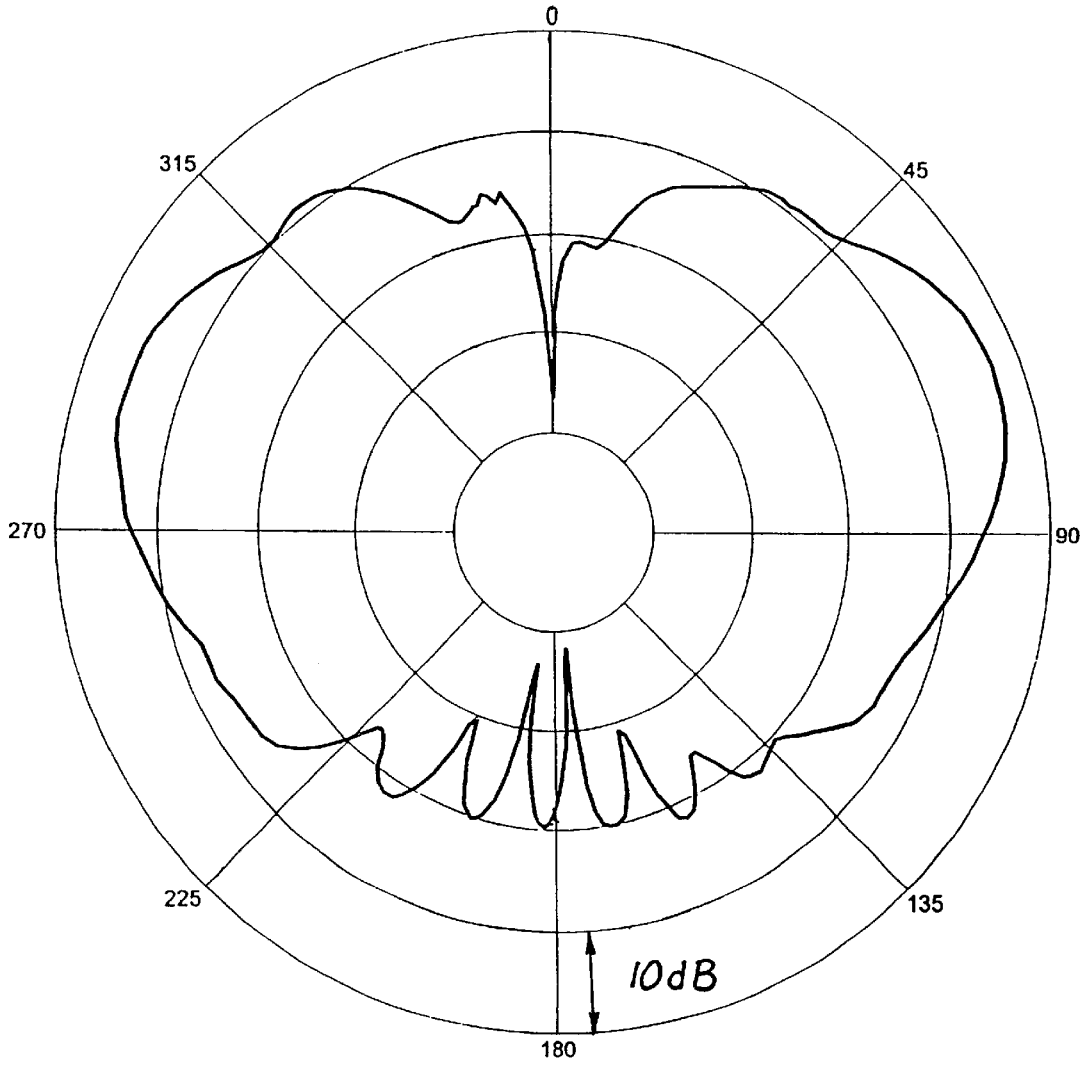
Fig. 5c PRIOR ART
Figure 5D:
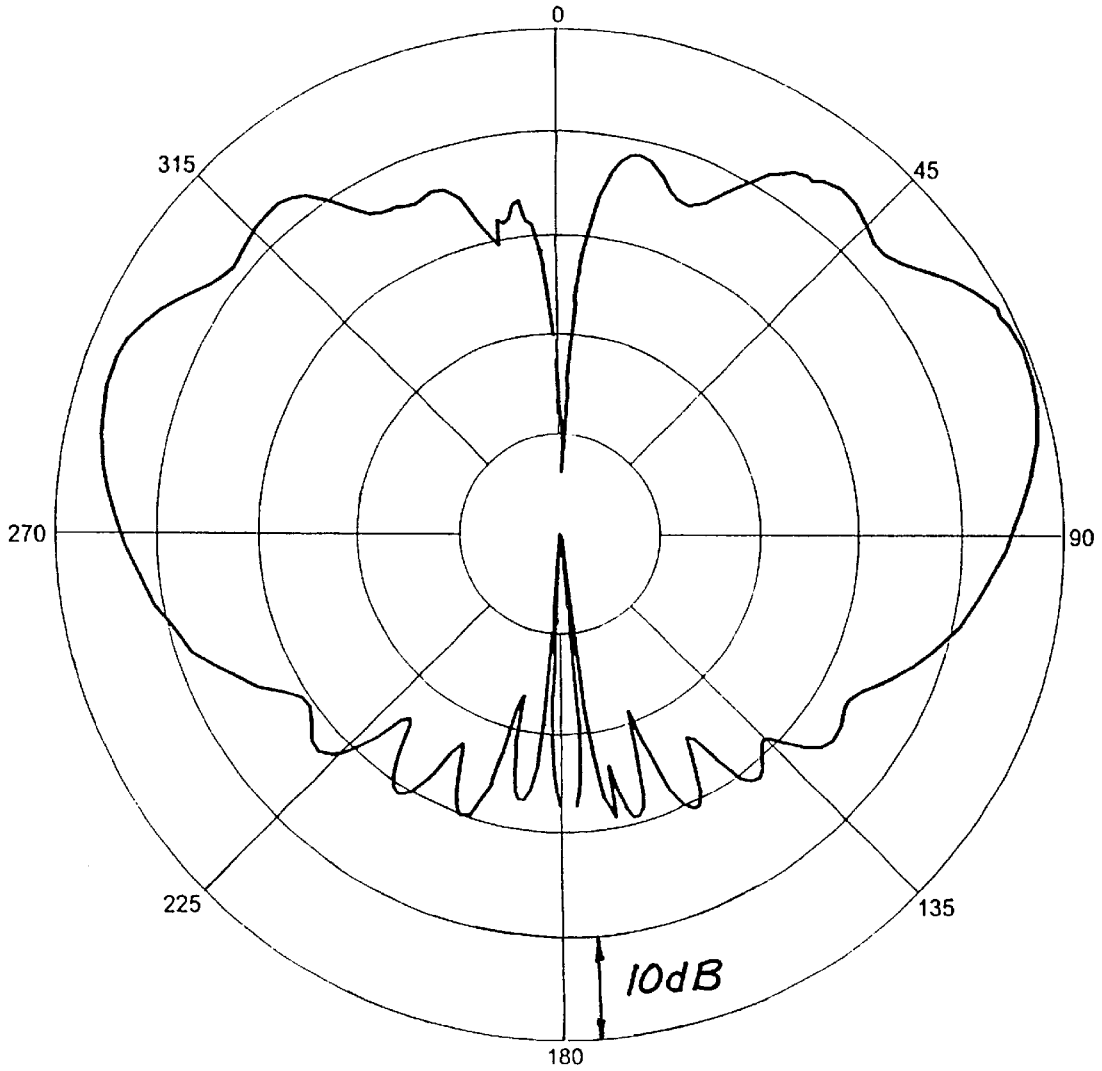
Fig. 5d PRIOR ART

Consider now the operation of ground plane mesh 24 when a wave is launched at one end of its surface using either a monopole antenna probe and received with a similar antenna at its opposing end as diagrammatically shown in the top plan view of FIGS. 3*a* and 3*b* for vertical and horizontal monopole antennas respectively. A strong transmission indicates coupling to a surface mode in ground plane mesh 24.

FIG. 4(*a*) is a graph showing the transmission amplitude in dBs as a function of frequency in GHz measured in the test configuration of FIG. 3(*a*). Lower band edge 54 is clearly shown in the experimental results depicted in 4(*a*) at about 28 GHz where the transmission amplitude drops sharply by 30 dB. Above the lower band edge 54, the surface currents are blocked by the pattern of parallel resonant circuits on the top surface of ground plane mesh 24. The upper band edge cannot be seen in the depiction of FIG. 4(*a*) since the measurement apparatus was limited to 50 GHz in its range.

Compare the transmission performance of the invention of FIG. 4(*a*) with that of a conventional plane metal sheet as shown in FIG. 4(*b*). Within the band gap, namely, the frequency range between the lower and upper band edges, transmission across the structure of the invention is 20 dB less than over ordinary metal sheet. Thus, a comparison of FIGS. 4(*a*) and (*b*) provide valid evidence for the suppression of surface current propagation in the ground plane mesh 24 of the invention.

Consider now the effects of ground plane mesh 24 on a small monopole antenna. In this test a coaxial cable is inserted through the rear side of ground plane mesh 24 with the center pin of the coaxial cable extending 2 mm beyond the front side of ground plane mesh 24 to thus serve as a monopole antenna. The outer conductor of the coaxial cable was connected to the continuous metal backside sheet 30 on the rear side of ground plane mesh 24. The antenna pattern as measured in an anechoic chamber as a function of angle is shown FIGS. 5(*a*) and 5(*b*) which are polar plots of the antenna pattern below and above the band edge, respectively. Below the band edge as shown in FIG. 5(*a*) the monopole antenna radiates in all directions including into the back hemisphere between 90° and 270°. The polar pattern shows the azimuthal distribution of the antenna gain with the radial distance from the center of the graph being the transmission intensity in dB. The front hemisphere would thus be the angles between 90° and 270° through 0° which would be the forward direction. The back hemisphere is between 90° and 270° through 180° which would be the rear facing direction.

The backward radiation of FIG. 5(*a*) is due to currents that propagate along the ground plane and radiate power from the edges. The pattern also contains many lobes due to surface currents forming standing waves on the ground plane. Above the band edge, the back plane currents are eliminated as dramatically shown in FIG. 5(*b*). The resulting antenna pattern is smooth and antenna rejection in the rear hemisphere is greater than 30 dB. Since the surface currents cannot propagate to the edges, the finite size and capacity of ground plane that was actually used appears as it if were infinite.

For comparison purposes, the same polar plots are shown in FIGS. 5(*c*) and 5(*d*) at the same frequencies but for a conventional metal ground plane or solid metal sheet. As expected, FIG. 5(*c*) and FIG. 5(*d*) both show many lobes and significant radiation into the back hemisphere.

Several conclusions can be drawn from the measurements described above. First, radio frequency surface currents are often present in a real antenna environment and they have a significant impact on the antenna radiation pattern. The ground plane mesh 24 of the invention substantially reduces RF surface wave propagation and achieves a corresponding improvement in the antenna pattern. Although the demonstration above involved a simple monopole, the results suggest that improvement of the invention is realized in many types of antennas. Ground plane mesh 24 of the invention can improve the efficiency of patch antennas which tend to lose significant power to surface waves. In phased arrays, the structure of the invention can reduce blind angle effects and coupling between elements. On aircraft, interference between nearby antennas can be reduced by using guard rings having the two dimensional geometry of the ground plane structure of the invention. In wireless telephony a surface devised according to the invention could be used to direct electromagnetic radiation away from the user. Most importantly, antenna designs that were previously impractical because of the deficiencies of a conventional metal ground plane now become feasible with the ground plane mesh 24.

A second important property of the invention is that it reflects an electromagnetic wave with a different phase than ordinary metal surfaces. The phase of reflection can be tested by launching a plane wave toward the surface using a horn antenna, and measuring the phase of the wave received by a second horn antenna. The phase of the reflected wave is shown in FIG. 6. Below the band gap at 28 GHz, the phase of the reflected wave is the same as with an ordinary metal surface indicating a phase shift of 180° on reflection. Near the band edge at 28 GHz, the phase shift passes through the value 90° while at 35 GHz the reflected wave has a zero phase shift. A ground plane with a zero phase shift would not have an electric field node at its surface, but rather an antinode. The antenna could then be placed very near the surface of ground plane mesh 24 without being shorted out.

A phase shift that varies with the frequency near the band edge at 28 GHz can be associated with an equivalent time group delay. It is natural to discuss what thickness of dielectric would be associated with the group delay of the monopole antenna illustrated in FIGS. 5(*a*) and (*b*). The equivalent thickness, considering the dielectric constant of material 26 at $\epsilon$=2.2, is equal to three times the actual thickness of ground plane mesh 24. Thus, the phase shift is not simply due to the thickness of ground plane mesh 24, but rather is an energy storage affect of the resonant circuit on the surface of ground plane mesh 24. Alternatively, it can be viewed as an enhanced effective dielectric constant due to the resonant nature of the material.

The invention can be used to improve the properties of antennas such as the simple monopole antenna by replacing the conventional metal ground plane with ground plane mesh 24. Elimination of radiation in the back hemisphere and smoothing of the antenna pattern can be expected from monopole antennas and antennas of other designs. By increasing the capacitance and inductance, it must be understood that structures fabricated according to the teachings of the present invention can operate not only at the microwave frequencies discussed in connection with the illustrated embodiment, but also operated at ultra high frequencies (UHF) or lower.

By increasing the capacitance and inductance in the parallel resonant circuits comprising ground plane mesh 24, the frequency of the lower band edge can be reduced. The surface current transmission across the structure is shown in FIG. 7(*a*) in which the band gap is clearly visible between 11 and 17 GHz. FIG. 7(*b*) shows the phase shift that occurs for electromagnetic waves that are reflected from a surface provided with this capacitance and inductance. At low frequencies, the reflection phase is 180° indicating the reflected wave is out of phase with the incident wave. In this low frequency range, the surface thus resembles an ordinary continuous metal ground plane sheet. As the frequency is increased beyond the lower band edge 54, the waves are reflected in phase. Within the band gap shown in shaded zone in the right portion of FIG. 7(*b*) the waves are reflected in phase. Thus within the band gap an antenna placed near such a structure would experience constructive interference from the reflected waves and would not be shorted out. The phase of the reflection crosses zero within the band gap and eventually approaches −180° for frequencies beyond the upper band edge 56.

Figure 8A:
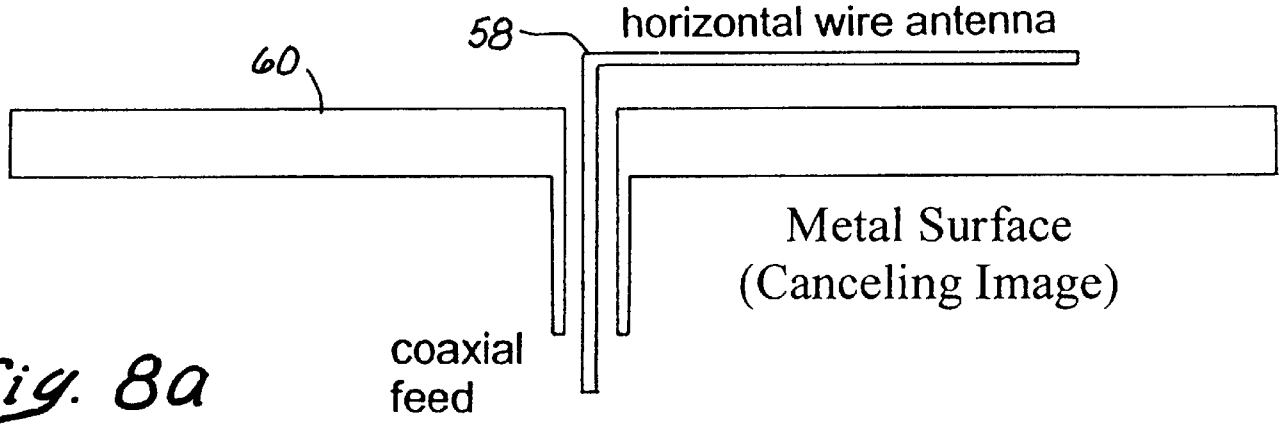
Fig. 8a PRIOR ART
FIG. 8(*a*) is a diagrammatic depiction of a horizontal wire antenna lying flat against a metal surface. This antenna will not radiate well due to destructive interference from the waves that are reflected from the metal surface since it is effectively shorted out by the metal surface or a canceling image formed in it.
Figure 8B:
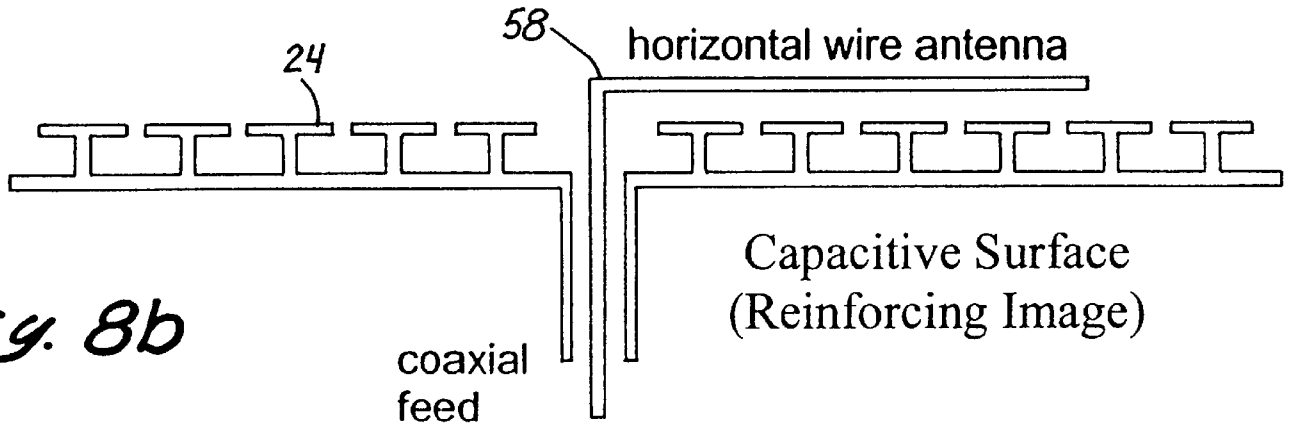

Ground plane mesh 24 of the invention thus allows the production of low profile antennas which were not possible on ordinary metal ground planes. FIG. 8(*a*) shows a prior art horizontal wire antenna 48 lying flat against or spaced slightly above a conventional metal ground plane 60 as might occur in the skin of the aircraft. FIG. 8(*b*) shows the same antenna 58 disposed above a ground plane mesh 24 of the invention. The S11 return loss of the antenna of FIG. 8(*a*) is shown in the graph of 9(*a*) wherein transmission is graphed against frequency. The S11 return loss is a measurement of the power reflected from the antenna back toward the source. This antenna reflects more than −3 dB or 50% of the power back into the microwave source thus providing a very poor radiation performance. Poor radiation performance understandably arises because of the unfavorable phase shift of the metal surface of ground plane 60 which causes destructive interference with the direct radiation from antenna 58 and the radiation reflected from metal surface 60.

Figure 9A:
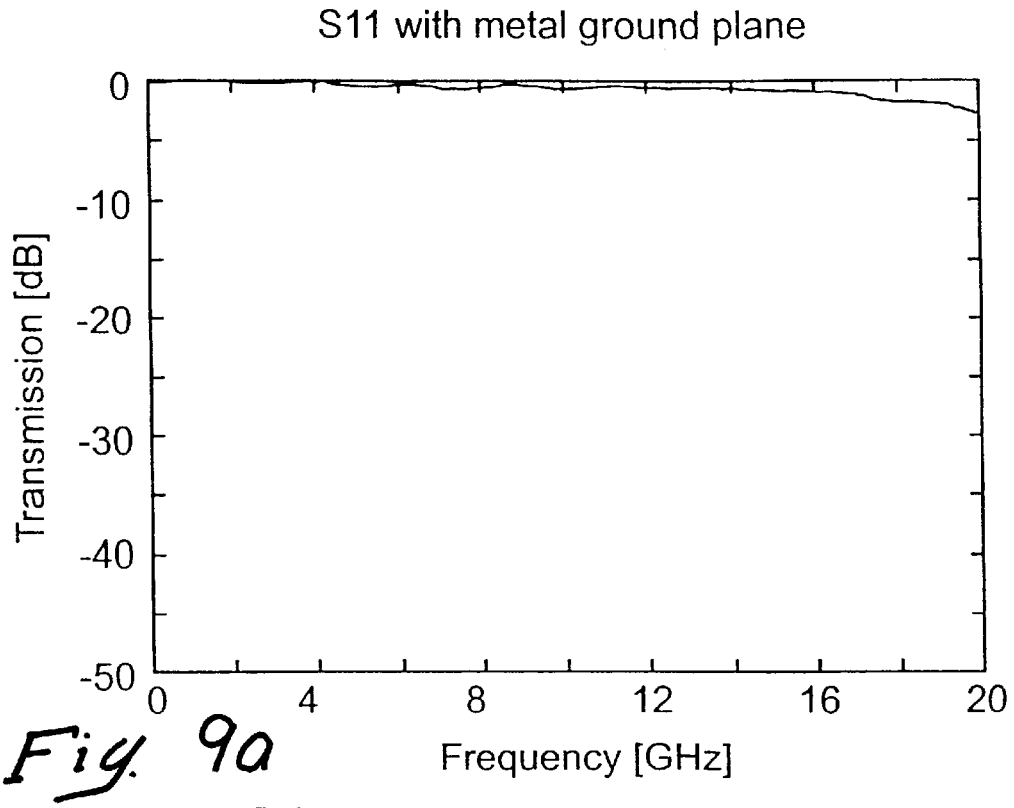
Fig. 9a PRIOR ART
FIG. 9(*a*) is a graph of the transmission as a function of frequency showing the S11 return loss for the horizontal wire antenna above the metal ground plane of FIG. 8(*a*). Return loss is more than minus 3 dB (50%) indicating that the antenna rotates poorly.
Figure 9B:
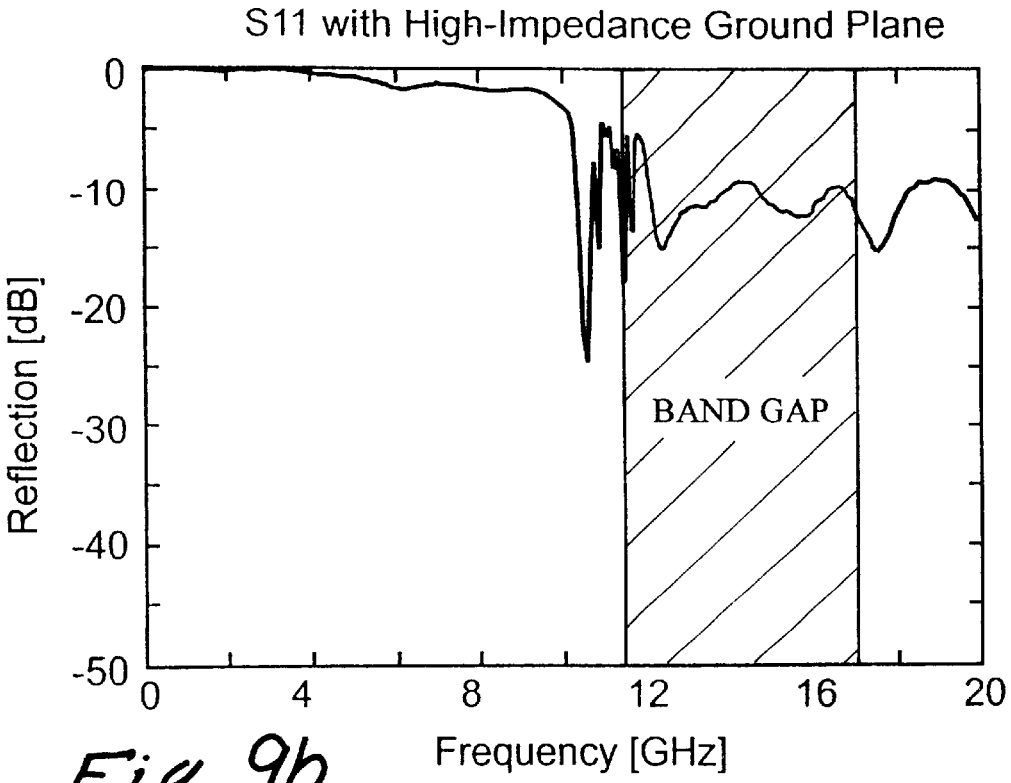

FIG. 9(*b*) shows the S11 return loss of the same antenna 58 with ground plane mesh 24. Below the band edge 54 antenna 58 also performs poorly resembling configuration of the antenna above a conventional metal ground plane shown in FIGS. 8(*a*) and 9(*a*). Above band edge 54, electromagnetic waves are reflected from the surface of ground plane mesh 24 in-phase thus reinforcing the direct radiation. Antenna 58 performs well with a return loss of about −10 dB (10%).

Figure 10A:
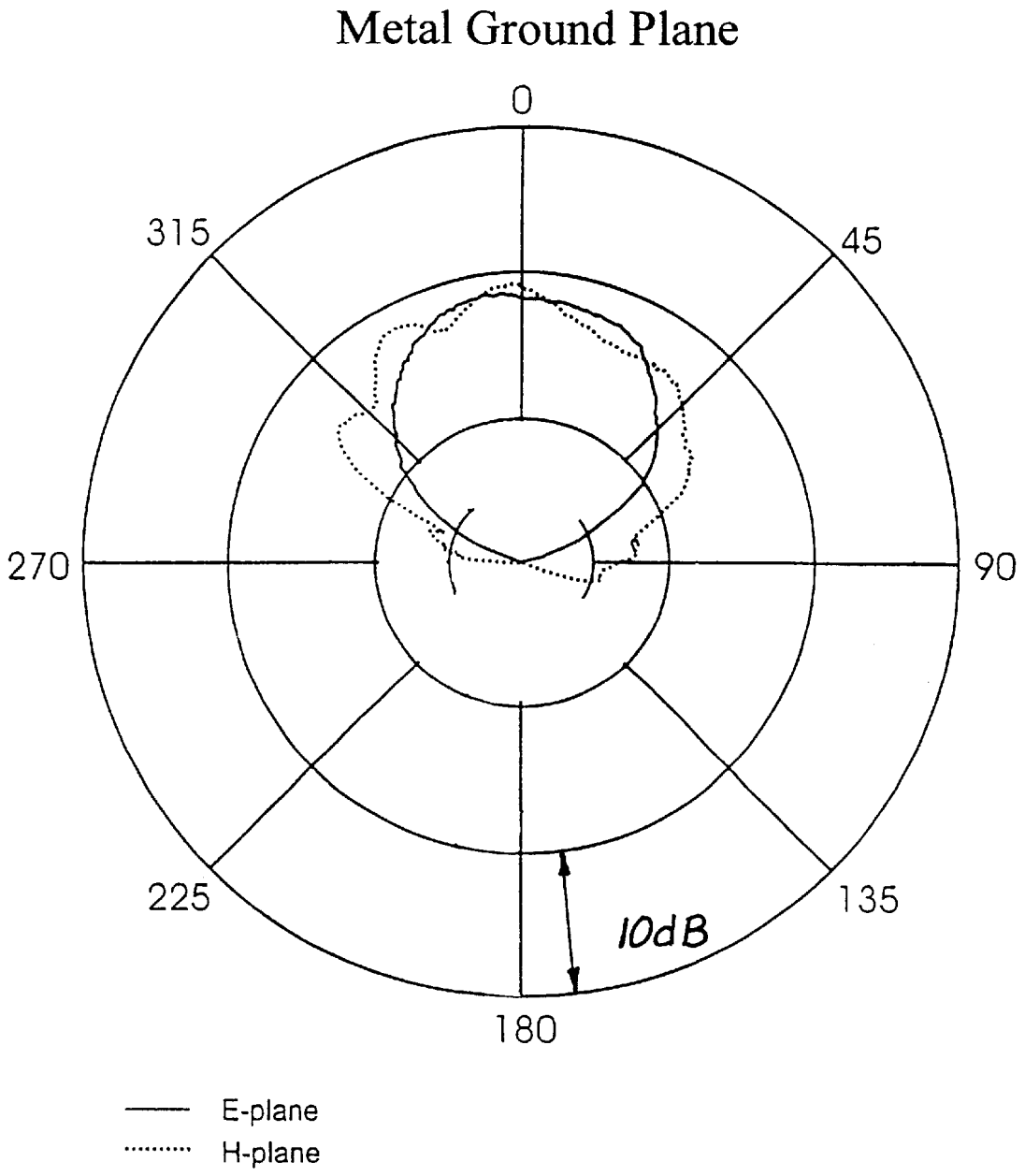
Fig. 10a PRIOR ART
FIG. 10(*a*) is the polar radiation graph of the antenna pattern for the horizontal wire antenna of FIG. 8(*a*).
Figure 10B:
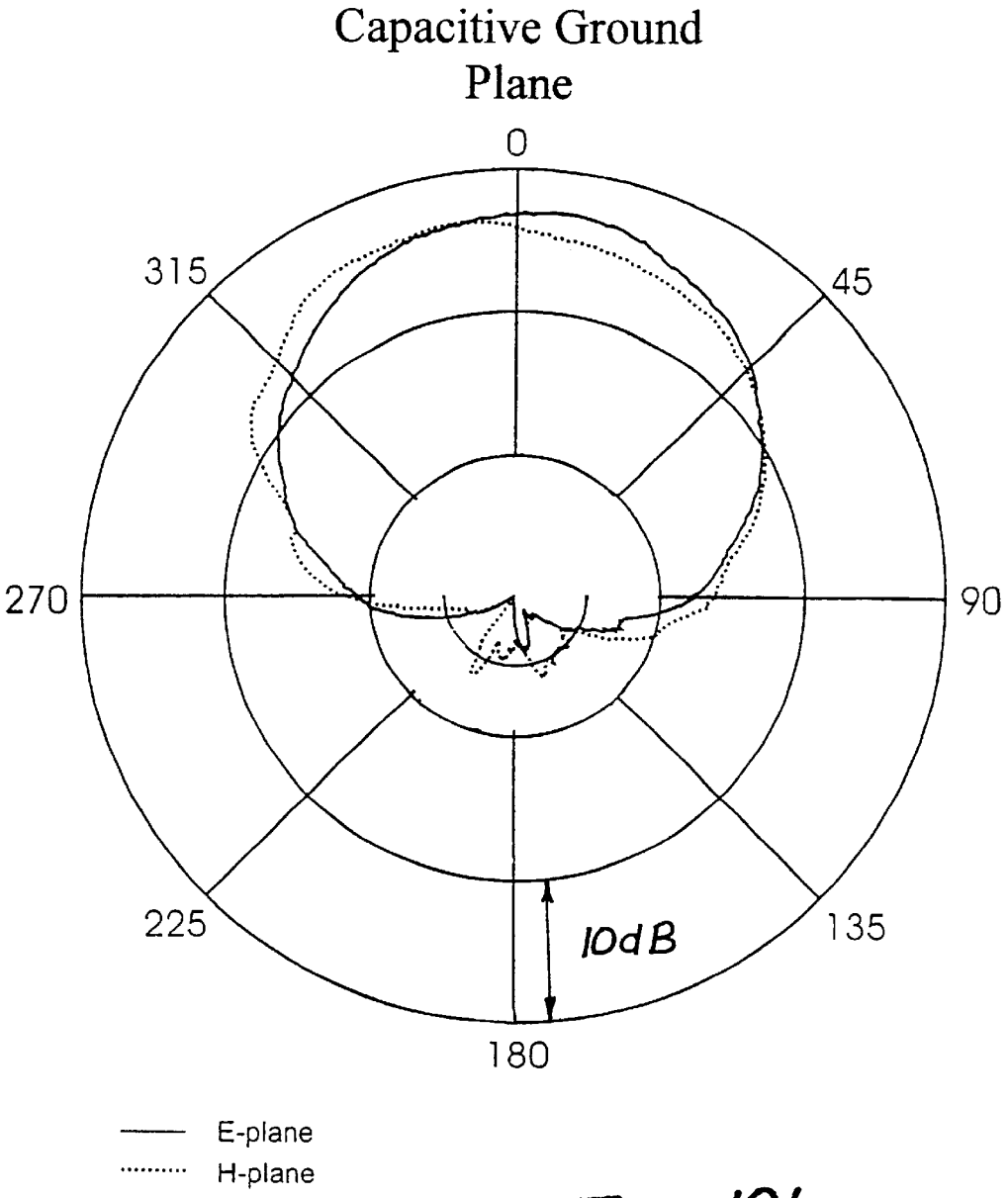

The polar radiation patterns of antenna 58 in the two ground plane configurations of FIGS. 8(*a*) and 8(*b*) are shown in FIGS. 10(*a*) and 10(*b*), respectively. Measurements were taken at 13 GHz and plotted on the same scale. Wire antenna 58 on ground plane mesh 24 has about 8 dB more gain than on the conventional metal ground plane thus agreeing with the S11 measurement.

Figure 11A:
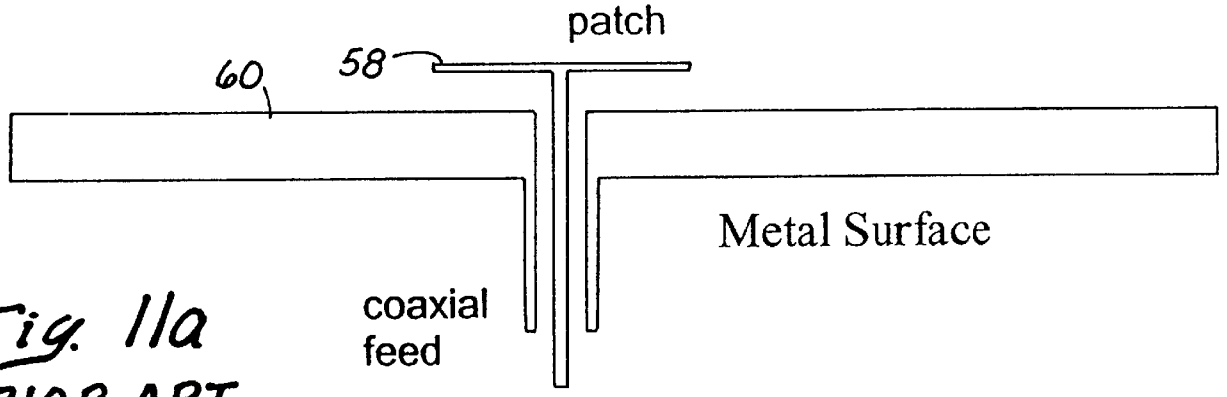
Fig. 11a PRIOR ART
FIG. 11(*a*) is a diagrammatic cross-section depiction of a patch antenna above the conventional continuous metal ground plane.
Figure 11B:
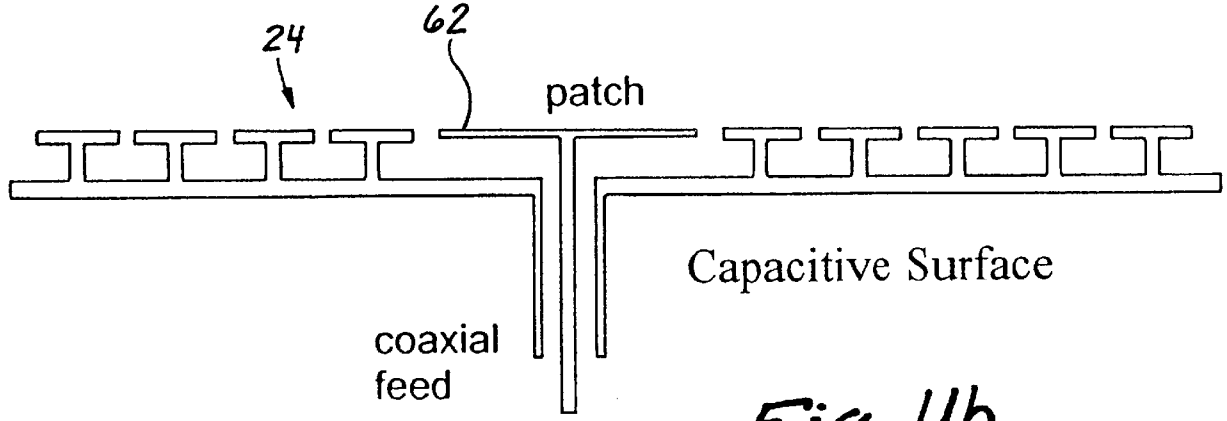
Figure 13A:
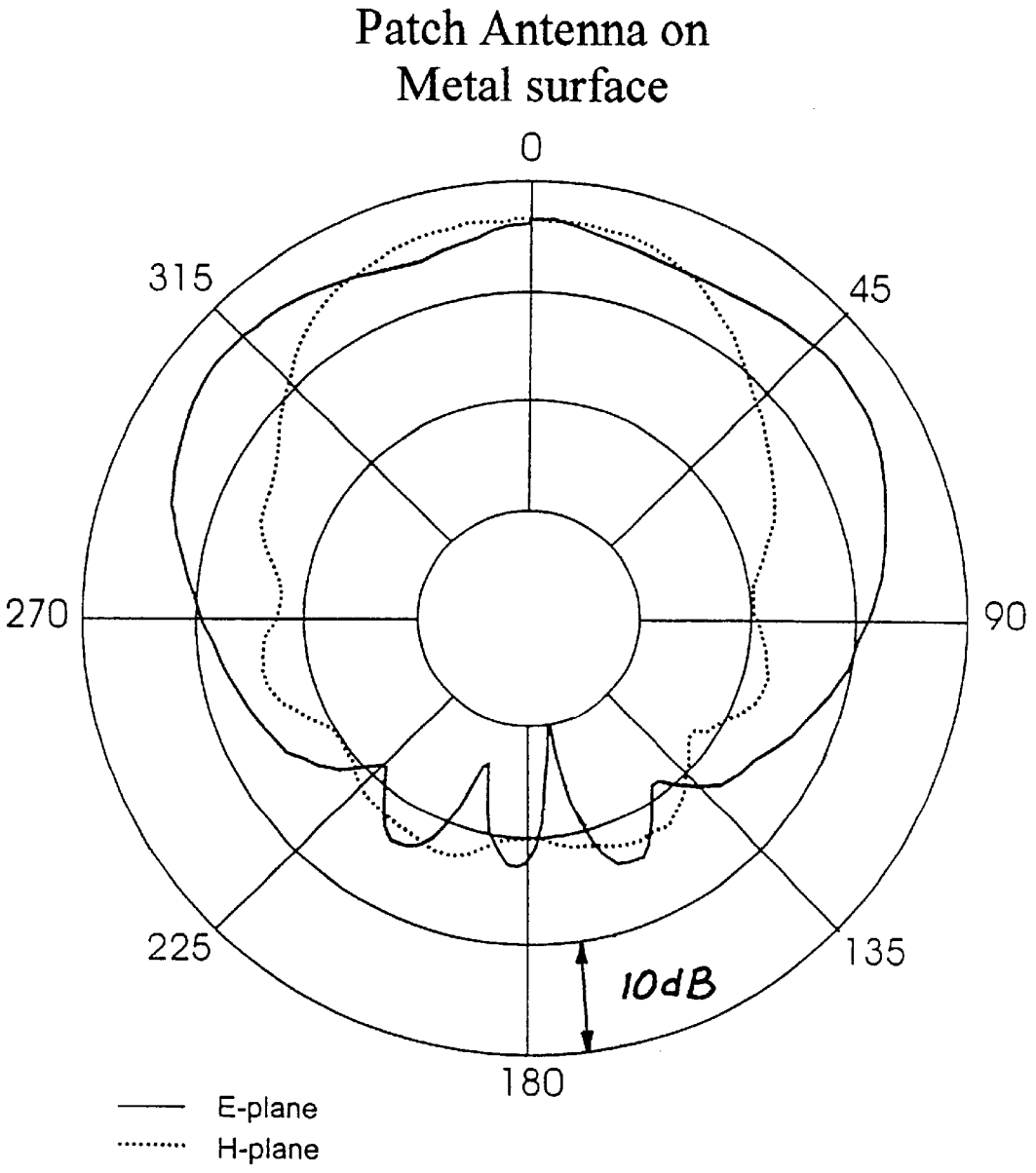
Fig. 13a PRIOR ART
FIG. 13(*a*) is a polar radiation pattern of the conventional patch antenna of FIG. 11(*a*). The pattern shows significant radiation of the backward hemisphere and the radiation pattern of the forward hemisphere is characterized by ripples. Both of these effects are caused by surface currents on the conventional metal ground plane. The E plane graph is shown in solid outline and the H plane graph in dotted.
Figure 13B:
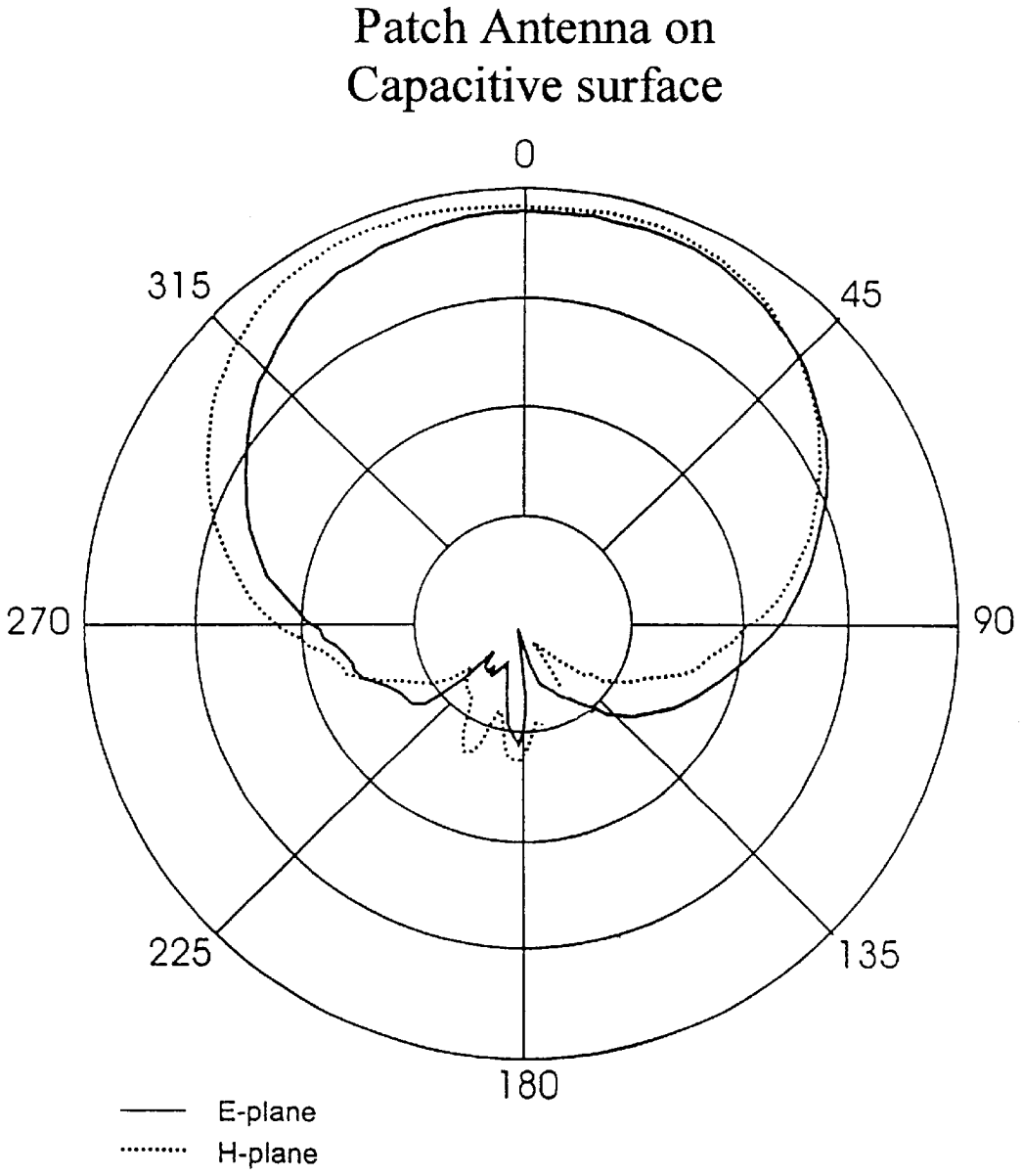

Similarly, FIGS. 11(*a*) and 11(*b*) are side cross-sections of diagrammatic depictions of patch antennas 62 mounted in FIG. 11(*a*) above an ordinary metal ground plane surface 60 and in FIG. 11(*b*) above ground plane mesh 24. The antenna return loss measured for the antenna configurations of FIGS. 11(*a*) and 11(*b*) are shown in the graph of FIG. 12. Both configurations have similar return losses and bandwidths. FIG. 13(*a*) shows polar radiation pattern of patch antenna 62 on metal surface 60 at 13.5 GHz where the return loss of both antennas is equal. The pattern has significant radiation in the backward hemisphere as well as ripples in the forward hemisphere. Both of these effects are caused by surface currents on the ground plane.

FIG. 13(*b*) shows a polar radiation pattern for patch antenna 62 with ground plane mesh 24. The pattern is smoother and more symmetric and has less radiation in the backward direction. The antenna also has about 2 dB more gain more than when used with conventional ground plane.

Figure 14A:
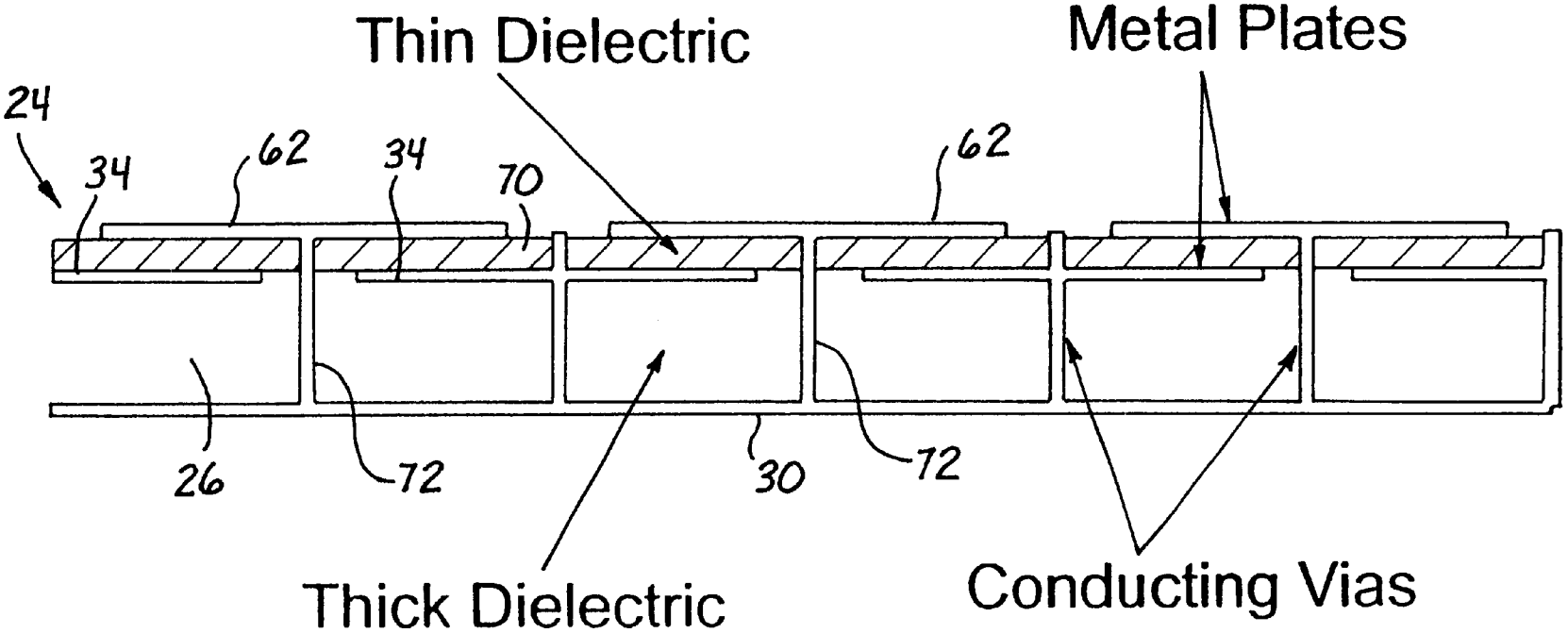
FIG. 14(*a*) is the side cross-sectional view of an alternate embodiment of the ground plane mesh in which the top metal patches form two overlapping layers, separated by a thin dielectric spacer. This increases the capacitance between adjacent elements, lowering the frequency.
Figure 14B:
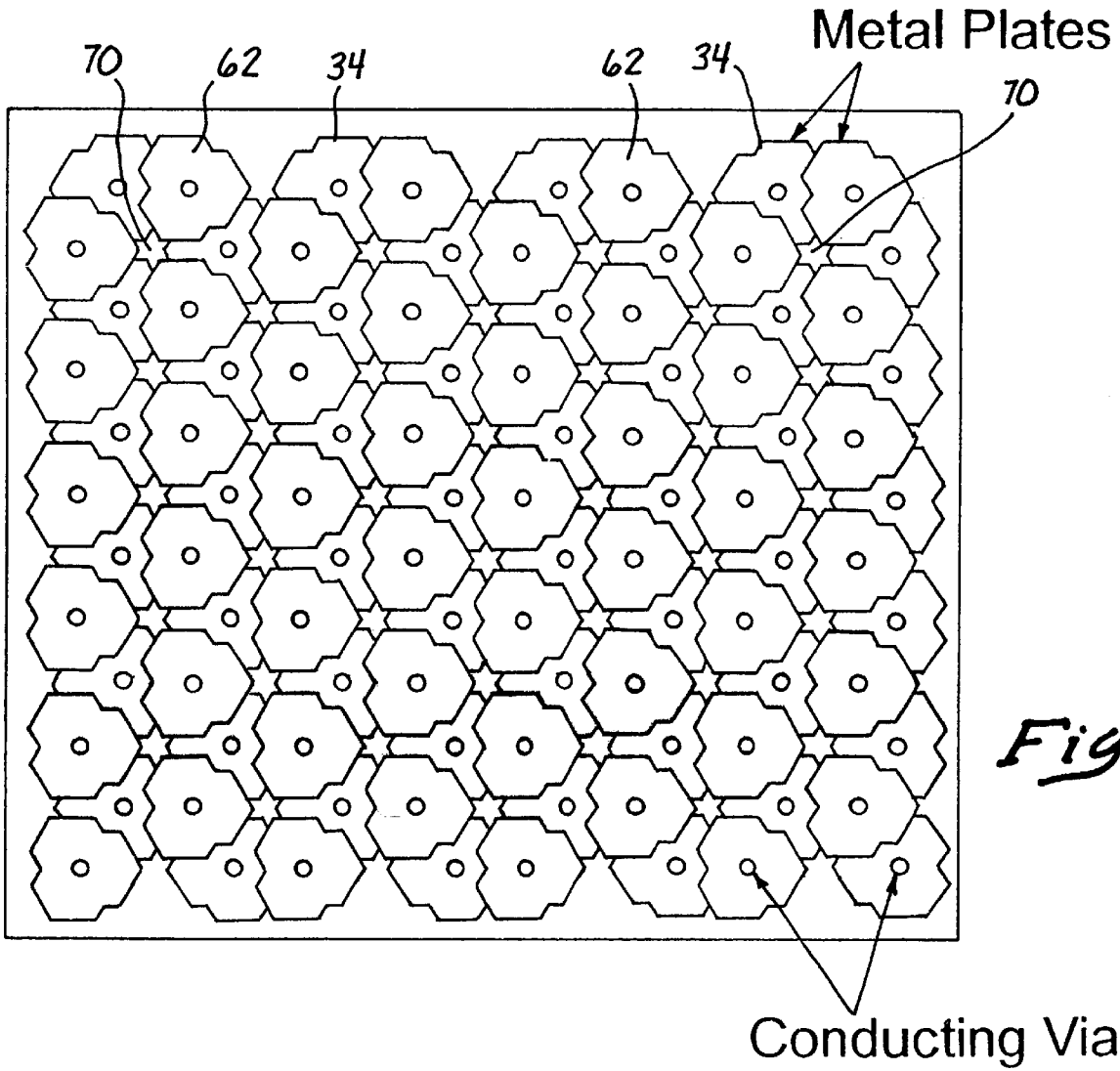

FIG. 14(*a*) is the side cross-sectional view of an alternate embodiment of ground plane mesh 24 in which the top metal patches 62 are disposed above and overlapping plates 34 in mesh 24 and separated from plates 34 by a thin dielectric spacer 70. FIG. 14(*b*) is a top plan view of the structure shown in FIG. 14(*a*). The top layer of metal patches are shown overlapping the second layer below. This increases the capacitance between adjacent elements, thereby lowering the frequency. Conducting vias 72 connect some or all of metal patches 62 to a solid metal sheet 30, which is separated from the multiple layers of metal patches 62 and plates 34 by a second dielectric layer 26. Additional layers of metal patches 62 and dielectric sheets 70 can be vertically added in addition to that shown in FIG. 14(*a*) as desired to realize a desired capacitance.

The electromagnetic characteristics of the ground plane mesh 24 of FIGS. 14(*a*) and 14(*b*) is depicted in the graphs of FIGS. 15(*a*) and 15(*b*). FIG. 15(*a*) is a graph of the surface wave transmission intensity versus frequency on the structure depicted in FIGS. 14(*a*) and 14(*b*). The band gap can be seen to cover the frequency range of 2.2 GHz to 2.5 GHz. FIG. 15(*b*) is a graph of the reflection phase of the structure depicted in FIGS. 14(*a*) and 14(*b*). The reflection phase crosses through zero at a frequency within the band gap.

Thus, it can be understood that the frequency of operation of ground plane mesh 24 can be tuned by adjusting the geometry. Low profile antennas on ground plane mesh 24 demonstratively perform better than similar antennas on solid metal ground planes. While the illustrated embodiment has shown only comparative use of a vertical monopole or horizontal wire and a patch antenna, other antenna designs could be employed in a similar manner. Both antenna configurations take advantage of the surface wave suppression, while the horizontal wire antenna benefits from the reflection of phase property of the surface of ground plane mesh 24 more than a patch antenna and provides thus a new antenna geometry that would not otherwise be possible.

In summary, it can be now realized that ground plane mesh 24 of the invention:

(1) is comprised of a metal ground plane incorporating a thin two dimensional arrangement of metal elements;

(2) each element is capacitively coupled to nearby elements and inductively coupled to the ground plane of the back sheet 30;

(3) mesh 24 forms a two dimensional network of parallel resonant circuits;

(4) parallel resonant circuits block surface current propagation on ground plane mesh 24; and (5) the resonant nature of ground plane mesh 24 alters the phase electromagnetic waves that are reflected from its surface.

Ground plane mesh 24 blocks the propagation of RF electric currents along its surface.

Many alterations and modifications may be made by those having ordinary skill in the art without departing from the spirit and scope of the invention. Therefore, A must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus for reducing electromagnetically induced surface currents in a ground plane comprising a plurality of distributed elements, each distributed element being a distributed resonant circuit, each of said distributed elements being interconnected with each other to form an array and each distributed resonant circuit having a surface disposed in a defined plane, said corresponding plurality of surfaces of said plurality of elements defining said ground plane.

2. The apparatus of claim 1 wherein each of said distributed elements electrically functions as discrete LC resonant circuit.

3. The apparatus of claim 2 wherein each of said distributed elements has a subplurality of adjacent distributed elements and is capacitively coupled to each of said adjacent distributed elements.

4. The apparatus of claim 3 wherein each of said plurality of distributed elements are inductively coupled together in common.

5. The apparatus of claim 1 wherein said array of distributed elements comprises:

a corresponding plurality of separate conductive patches forming a surface; and a common conductive back plane separated by a predetermined distance from said surface of said patches, said plurality of patches forming a common surface, each of said plurality of patches being coupled by a conductive line to said separated back plane.

6. The apparatus of claim 5 further comprising a dielectric material disposed between said back plane and said surface defined by said plurality of elements.

7. The apparatus of claim 6 wherein said dielectric material is a dielectric sheet, said plurality of patches is conductive patches formed on a first surface of said dielectric sheet and said back plane is a continuous conductive surface disposed on an opposing surface of said dielectric sheet, said lines connecting said patches to said back plane being metalizations formed in vias defined through said dielectric sheet.

8. The apparatus of claim 7 wherein said patches are hexagonal metalizations defined on said first surface of said dielectric sheet.

9. The apparatus of claim 1 wherein said plurality of resonant distributed elements are parameterized to substantially block surface current propagation in said apparatus within a predetermined frequency band gap.

10. The apparatus of claim 1 wherein said plurality of distributed elements are parameterized to reflect electromagnetic radiation from said apparatus with a zero phase shift at a frequency within a frequency band gap.

11. The apparatus of claim 1 further comprising an antenna disposed above said surface of resonant distributed elements.

12. The apparatus of claim 11 wherein said antenna is comprised of a radiative element disposed parallel to said surface of said resonant distributed elements which act as a ground plane for said antenna.

13. The apparatus of claim 12 wherein said antenna is a wire antenna.

14. The apparatus of claim 12 wherein said antenna is a patch antenna.

15. The apparatus of claim 14 wherein said patch antenna is substituted in position for one of said resonant distributed elements and is disposed in said surface of said resonant distributed elements.

16. The apparatus of claim 1 where said plurality of distributed elements comprise at least a first and second set of distributed elements, said first set of distributed elements being disposed in a first defined plane which comprises said ground plane, said second set of distributed elements being disposed in a second defined plane, said second defined plane being disposed above and spaced apart from said first ground plane, said arrays formed by said first and second sets of distributed elements each forming an overlapping mosaic wherein each distributed element of said second set overlaps and is spaced apart from at least one of said distributed elements in said first set of distributed elements.

17. The apparatus of claim 16 wherein said first and second set of distributed elements each comprises in turn one or more corresponding subsets of distributed elements, each subset of said first set of distributed elements being stacked over each other and each subset of said second set of distributed elements being stacked over each other, said subset of said first set of distributed elements being spaced apart from and adjacent to at least one subset of said second distributed elements, so that two or more layers of alternating overlapping arrays of said first and second set of distributed elements is provided.

18. The apparatus of claim 16 where said first set of distributed elements comprises:

a corresponding plurality of separate first conductive patches forming said corresponding first defined plane; and a common conductive back plane separated by predetermined distance from said surface of said first conductive patches, said plurality of first conductive patches forming a common surface, each of said plurality of first conductive patches being coupled by a conductive line to said separated back plane; and a first dielectric material disposed between said back plane and said first conductive patches.

19. The apparatus of claim 16 where said second set of distributed elements comprises:

a corresponding plurality of separate second conductive patches forming said corresponding second defined plane; and a second dielectric material disposed between said first and second conductive patches.

20. A method of reducing surface currents in a conductive surface comprising:

providing said conductive surface with a two dimensional array of a plurality of resonant distributed elements, each resonant distributed element being coupled with each other and parameterized by geometry and materials to collectively exhibit a frequency band gap in which surface propagation is substantially reduced; and radiating electromagnetic energy from a source disposed above said surface of resonant distributed elements at a frequency within said frequency band gap so that electromagnetic radiation reflected from said surface has a zero phase shift at a frequency within said frequency band gap.

21. The method of claim 20 wherein providing said surface provides a plurality of periodic or nearly periodic array of conductive elements, each conductive element of said array having a subplurality of adjacent conductive elements and capacitively coupled with said subplurality of adjacent conductive elements, each of said plurality of conductive elements being inductively coupled in common with each other.

22. The method of claim 21 wherein providing said resonant array of distributed elements provides a plurality of conductive patches defining said periodic or nearly periodic array on a first surface and a continuous conductive second surface separated by a predetermined distance from said first surface, each of said conductive patches of said first surface being inductively coupled to said continuous conductive second surface.

23. The method of claim 20 where radiating electromagnetic energy from a source comprises radiating electromagnetic energy from a wire antenna disposed parallel and adjacent to said surface of said array of distributed elements.

24. The method of claim 20 where radiating electromagnetic energy from a source comprises radiating electromagnetic energy from an antenna disposed in said surface of said array of resonant distributed elements.

* * * * *

US006262495C1

(12) REEXAMINATION CERTIFICATE (4820th)

United States Patent

Yablonovitch et al.

(10) Number: US 6,262,495 C1

(45) Certificate Issued: Jul. 22, 2003

(54) CIRCUIT AND METHOD FOR ELIMINATING SURFACE CURRENTS ON METALS

(75) Inventors: Eli Yablonovitch, Malibu, CA (US); Dan Sievenpiper, Los Angeles, CA (US)

(73) Assignee: The Regents of the University of California, Oakland, CA (US)

Reexamination Request:
No. 90/006,292, May 15, 2002

Reexamination Certificate for:

| | |
|---|---|
| Patent No.: | **6,262,495** |
| Issued: | **Jul. 17, 2001** |
| Appl. No.: | **09/255,832** |
| Filed: | **Feb. 23, 1999** |

Related U.S. Application Data

(60) Provisional application No. 60/079,953, filed on Mar. 30, 1998.

(51) Int. Cl.[7] ..... H01Q 1/38

(52) U.S. Cl. ..... 307/101; 327/593; 333/12

(58) Field of Search ..... 307/101; 327/593; 333/12, 235; 343/700 R; 331/117 R; 257/259; 365/54

(56) References Cited

U.S. PATENT DOCUMENTS 6,100,855 A * 8/2000 Vinson et al. ..... 343/846

FOREIGN PATENT DOCUMENTS

EP 0 716 470 A1 * 6/1996 ..... H01Q/9/04

WO WO 99/50929 * 10/1999 ..... H01Q/1/38

OTHER PUBLICATIONS

Walser et al., "New smart materials fpr adoptive microwave signature control.", Jul. 1993.*

Broussaud, G., "Study of the Diffraction of Electromagnetic Waves Through a Network of Plates Drilled with Holes.", Radioelectricity Annals, Jan. 1955.*

* cited by examiner

*Primary Examiner*—Fritz M. Fleming

(57) ABSTRACT

A two dimensional periodic pattern of capacitive and inductive elements defined in the surface of a metal sheet are provided by a plurality of conductive patches each connected to a conductive back plane sheet between which an insulating dielectric is disposed. The elements acts to suppress surface currents in the surface defined by them. In particular, the array forms a ground plane mesh for use in combination with an antenna. The performance of a ground plane mesh is characterized by a frequency band within which no substantial surface currents are able to propagate along the ground plane mesh. Use of such a ground plane in aircraft or other metallic vehicles thereby prevents radiation from the antenna from propagating along the metallic skin of the aircraft or vehicle. This eliminates surface currents between the antenna and the ground plane thereby reducing power loss and unwanted coupling between neighboring antennae. The surface also reflects electromagnetic waves without the phase shift that occurs on a normal metal surface. This allows antennas to be constructed that were previously impractical.

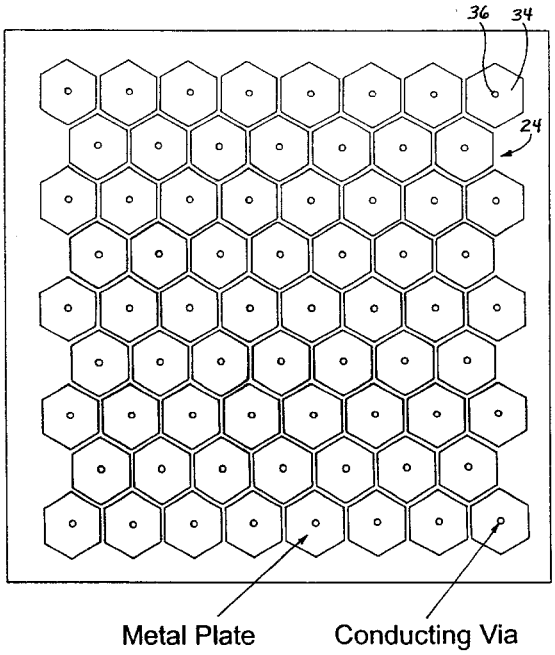

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 20 are determined to be patentable as amended.

Claims 2–19 and 21–24, dependent on an amended claim, are determined to be patentable.

1. An apparatus for reducing electromagnetically induced surface currents *at a frequency having a free space wavelength, λ, and* in a ground plane comprising a plurality of distributed elements *collectively forming a periodic two-dimensional mesh with a periodicity, a*, each distributed element being a distributed resonant circuit, each of said distributed elements being interconnected with each other to form an array and each distributed resonant circuit having a surface disposed in a defined plane,

*wherein each distributed element is substantially equally electromagnetically coupled to each adjacent distributed element, regardless of location within said array, and regardless of the direction of the element-to-element orientation within the array,* said corresponding plurality of surfaces of said plurality of elements defining said ground plane,

*wherein the periodicity of the elements is much less than the free space wavelength* ($a \ll \lambda$).

20. A method of reducing surface currents in a conductive [surface] *ground plane* comprising:

providing said conducive surface with a two dimensional array of a plurality of resonant distributed elements, each resonant distributed element being coupled with each other and parameterized by geometry and materials to collectively exhibit a frequency band gap in which surface propagation is substantially reduced, *regardless of the direction of the surface propagation in the two-dimensional array, and wherein each distributed element is substantially equally electromagnetically coupled to each adjacent distributed element, regardless of location within said array, and regardless of the direction of the element-to-element orientation within the array*; and, radiating electromagnetic energy from a source disposed above said surface of resonant distributed elements at a frequency within said frequency band gap so that electromagnetic radiation reflected from said surface has a zero phase shift at a frequency within said frequency band gap.

* * * * *